US012029358B2

(12) United States Patent
Kwacz

(10) Patent No.: US 12,029,358 B2
(45) Date of Patent: Jul. 9, 2024

(54) BATH WITH HOT AND COLD WATER ZONES

(71) Applicant: Kohler Co., Kohler, WI (US)

(72) Inventor: Jason Kwacz, Kohler, WI (US)

(73) Assignee: KOHLER CO., Kohler, WI (US)

( * ) Notice: Subject to any disclaimer, the term of this patent is extended or adjusted under 35 U.S.C. 154(b) by 0 days.

(21) Appl. No.: 17/858,627

(22) Filed: Jul. 6, 2022

(65) Prior Publication Data

US 2023/0008389 A1 Jan. 12, 2023

Related U.S. Application Data

(60) Provisional application No. 63/220,172, filed on Jul. 9, 2021.

(51) Int. Cl.
*A47K 3/022* (2006.01)
*A47K 3/10* (2006.01)

(52) U.S. Cl.
CPC ..... *A47K 3/022* (2013.01); *A47K 3/10* (2013.01)

(58) Field of Classification Search
CPC ..... A47K 3/022; A47K 3/10
USPC ..... 4/541.1, 489
See application file for complete search history.

(56) References Cited

U.S. PATENT DOCUMENTS 3,460,166 A 8/1969 Weber
4,443,900 A * 4/1984 Remeyer ..... A61H 33/6021 4/488
4,514,868 A 5/1985 Visinand
4,761,838 A 8/1988 Hargrove
5,241,958 A 9/1993 Noeldner
5,415,221 A * 5/1995 Zakryk ..... E04H 4/129 165/47
5,720,056 A * 2/1998 Aymes ..... E04H 4/005 4/488
6,425,999 B1 7/2002 Huang
7,712,161 B2 5/2010 Reynolds, II
7,870,621 B2 1/2011 Zeng
7,926,126 B2 4/2011 Whitley
8,393,019 B1 3/2013 Cavuoti
9,386,887 B2 7/2016 Haddad
(Continued)

FOREIGN PATENT DOCUMENTS

AU 2010202868 A1 1/2011
CA 1176403 A 10/1984
(Continued)

OTHER PUBLICATIONS

Atera Spas; Truezone Dual Swim Spa Prices; Dated Apr. 19, 2021 6 Pages.

*Primary Examiner* — Huyen D Le
(74) *Attorney, Agent, or Firm* — FOLEY & LARDNER LLP

(57) ABSTRACT

A bath receptor includes a water inlet, a first basin, a second basin, and a partition positioned between the first basin and the second basin. The water inlet is configured to supply water to the bath receptor. The first basin includes a first whirlpool system configured to direct water in a first direction within the first basin. The second basin includes a second whirlpool system configured to direct water in a second direction within the second basin. The second direction opposite the first direction. The partition is vertically provided along at least a portion of a height of the bath receptor.

18 Claims, 16 Drawing Sheets

(56) References Cited

U.S. PATENT DOCUMENTS

| | | | | |
|---|---|---|---|---|
| 9,392,912 | B2 | 7/2016 | Haddad | |
| 10,208,496 | B2 | 2/2019 | Sanchez | |
| 2005/0246830 | A1 | 11/2005 | Galyean et al. | |
| 2007/0226890 | A1 | 10/2007 | Pflueger | |
| 2009/0083903 | A1 | 4/2009 | Badiac | |
| 2010/0095448 | A1 | 4/2010 | Goldmann et al. | |
| 2019/0328576 | A1 | 10/2019 | Lowe et al. | |
| 2020/0337504 | A1* | 10/2020 | Swiney ..... | A47K 4/00 |

FOREIGN PATENT DOCUMENTS

| | | | |
|---|---|---|---|
| CN | 103845200 | A | 6/2014 |
| CN | 206979421 | U | 2/2018 |
| CN | 111588623 | A | 8/2020 |
| RU | 2161945 | C1 | 1/2001 |
| WO | WO-2006/134391 | A2 | 12/2006 |
| WO | WO-2008/037227 | A1 | 4/2008 |
| WO | WO-2008/137554 | A1 | 11/2008 |
| WO | WO-2016/156672 | A1 | 10/2016 |
| WO | WO-2017/206154 | A1 | 12/2017 |
| WO | WO-2020/055842 | A1 | 3/2020 |

* cited by examiner

BATH WITH HOT AND COLD WATER ZONES

CROSS-REFERENCE TO RELATED PATENT APPLICATION

This application claims the benefit of and priority to U.S. Provisional Patent Application No. 63/220,172, filed Jul. 9, 2021, the entire disclosure of which is incorporated by reference herein.

BACKGROUND

The present disclosure relates generally to bases or receptors for baths (e.g., showers, bath rubs, etc.) and sinks.

Generally speaking, bath receptors are vessels that are configured for receiving water in a bathroom or other environment. Usually, a faucet or other water delivery device is located proximate to the bath receptor, and a drain pipe is coupled to the sink to remove unwanted water.

SUMMARY

At least one embodiment relates to a bath system that includes a bath receptor. The bath receptor includes a water inlet, a first basin, a second basin, and a partition positioned between the first basin and the second basin. The water inlet is configured to supply water to the bath receptor. The first basin includes a first whirlpool system configured to direct water in a first direction within the first basin. The second basin includes a second whirlpool system configured to direct water in a second direction within the second basin. The second direction opposite the first direction. The partition is vertically provided along at least a portion of a height of the bath receptor.

Another example embodiment relates to a bath receptor. The bath receptor includes a first basin and a second basin. The first basin includes a first whirlpool system fluidly coupled to the first basin and includes a heating element configured to heat water passing through the first whirlpool system. The first whirlpool system is configured to direct hot water in a first direction. The second basin includes a second whirlpool system fluidly coupled the second basin and includes a cooling element configured to cool water passing through the second whirlpool system. The second whirlpool system is configured to direct cold water in a second direction. The first whirlpool system forms a hot water vortex within the first basin and wherein the second whirlpool system forms a cold water vortex within the second basin.

Another example embodiment relates to a water circulation system. The water circulation system includes a first basin, a second basin, and a partition positioned between the first basin and the second basin. The first basin includes a first whirlpool system fluidly coupled to the first basin. The first whirlpool system includes a heating element configured to heat water passing through the first whirlpool system to form hot water. The second basin includes a second whirlpool system fluidly coupled to the second basin. The second whirlpool system includes a cooling element configured to cool water passing through the second whirlpool system to form cold water. The partition is positioned between the first basin and the second basin. The hot water and the cold water converge on a contact plane vertically provided above the partition.

This summary is illustrative only and should not be regarded as limiting.

BRIEF DESCRIPTION OF THE FIGURES

The disclosure will become more fully understood from the following detailed description, taken in conjunction with the accompanying figures, wherein like reference numerals refer to like elements, in which.

DETAILED DESCRIPTION

Figure 1:
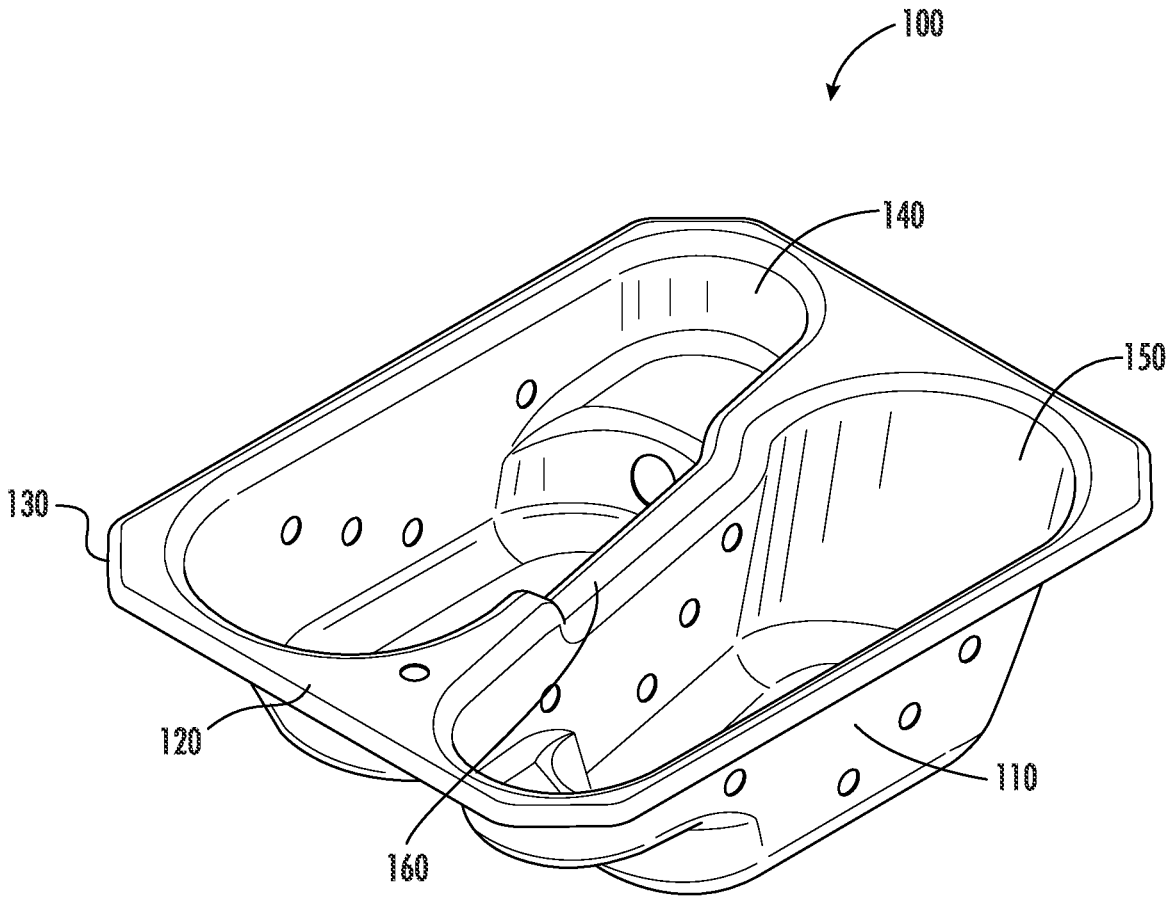
FIG. 1 is a perspective view of a bath system, according to an exemplary embodiment.

Before turning to the Figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Referring generally to the Figures, a bath system 100, 500 is disclosed according to various embodiments. The bath system 100, 500 is configured for use in bathroom environment. The bath system 100 may include at least one of a water inlet, a hot water zone, a cold water zone, and a partition between the hot water zone and the cold water zone. The bath system 100, 500 is further configured to be a substantially rectangular geometry. In some embodiments, the bath system 100, 500 may be any geometrical configuration (e.g., circular, conical, etc.). According to various embodiments, the bath system 100, 500 further includes a plurality of whirlpool nozzles. The whirlpool nozzles are configured to introduce water circulation into the bath system 100, 500.

In some embodiments, the bath system 100, 500 includes at least one of a plurality of basins. The plurality of basins include at least one of a plurality of sidewalls positioned along the perimeter of the bath system 100, 500. A first basin may be configured to be a hot water zone. A second basin may be configured to be a cold water zone. The hot water zone may be coupled to an inline heater, where the inline heater is fluidly coupled to the hot water zone. The cold water zone may be coupled to an inline chiller, where the inline chiller is fluidly coupled to the cold water zone. The inline heater is configured to heat the water disposed within the hot water zone, such to create a hot water zone. The inline chiller is configured to cool the water disposed within the cold water zone, such to create a cold water zone.

The hot water zone and the cold water zone may include a first whirlpool system and a second whirlpool system, respectively. The first whirlpool system is configured to circulate hot water throughout the hot water zone. The second whirlpool system is configured to circulate cold water throughout the cold water zone. According to an exemplary embodiment, constant water circulation throughout the bath system reduces the mixing of hot water and cold water over the partition. The continuous water circulation maintains the water temperature in the respective zone, such that the user may easily transition between hot water and cold water.

The hot water zone and the cold water zone are separated in the bath system 100, 500 by a partition. The partition is configured to not be disposed along the entire length of the sidewalls, such that a gap is configured to be formed between the top of the sidewalls and the top of the partition. When the water is filled in the bath system 100 above the top of the partition, water may flow between at least one of the hot water zone and the cold water zone to mix the water.

Referring to FIG. 1, a perspective view of a bath receptor, shown as bath system 100, is shown, according to an exemplary embodiment. The bath system 100 may comprise a plurality of sidewalls 110 positioned around the perimeter of the bath system 100. By way of example, the bath system 100 may include four sidewalls 110, where the plurality of sidewalls 110 are positioned adjacent to one another. In some embodiments, the bath system 100 may include any number of sidewalls 110 positioned in various locations around the bath system 100. The sidewalls 110 may be continuous (e.g., connected to each other) or broken (e.g., gaps between adjacent sidewalls 110 or within a single sidewall 110) and may define the structure shown in FIG. 1. The bath system 100 may further include a rim 120 disposed along the top of the bath system 100 and coupled to at least one of the plurality of sidewalls 110. The rim 120 may be configured to support some or all of the weight of the bath system 100 (e.g., hanging from the rim 120) and can be characterized as a support rim 120, where the rim 120 interfaces with a mounting surface (e.g., tile, granite, wood, etc.) when the bath system 100 is mounted into a bathing environment (e.g., bathroom, etc.). The plurality of sidewalls 110 abut one another at corners, shown as bath corners 130. The bath corners 130 may be substantially flat portions (e.g., chamfered corners) that couple one sidewall 110 to another. In some embodiments, the bath corners 130 may be curved portions (e.g., filleted corners) positioned between at least two of the plurality of sidewalls 110. By way of example, the bath system 100 may comprise four bath corners 130, positioned adjacent to one another (e.g., at each corner) along the perimeter of the bath system 100.

The bath system 100 may further include a set of basins, shown as first basin 140 and second basin 150. The set of basins 140 and 150 may be coupled to at least a portion of the rim 120. In some embodiments, the set of basins 140 and 150 may be coupled to the plurality of sidewalls 110. The set of basins 140 and 150 may be cylindrical basins. As can be appreciated, cylindrical basins promote water circulation within the set of basins 140 and 150. In some embodiments, the set of basins 140 and 150 may have any geometrical configuration (e.g., any shape or structure), including the configuration shown in FIG. 1. Positioned between the set of basins 140 and 150 is a divider, shown as partition 160. The partition 160 may be a divider disposed along a portion of a height of the bath system 100 (e.g., extending from the bottom to the top of the bath system 100). In some embodiments, the partition 160 may be disposed along the entire height of the bath system 100, or along a portion of the height (e.g., extending partially from the bottom to the top of the bath system 100). In still some embodiments, the partition 160 may prevent the transition of water between the set of basins 140 and 150. By way of example, the partition 160 may be disposed along the height of the bath system that makes it advantageous for the user to easily transition between the set of basins 140 and 150 without allowing excess water to transition between the set of basins 140 and 150. For example, the partition 160 may include a recess extending downward from the top of the bath system 100 that allows a user to move between the basins 140 and 150 without needing to elevate fully to the top of the bath system 100. In still some embodiments, the bath system 100 may not include a partition 160.

Figure 2:
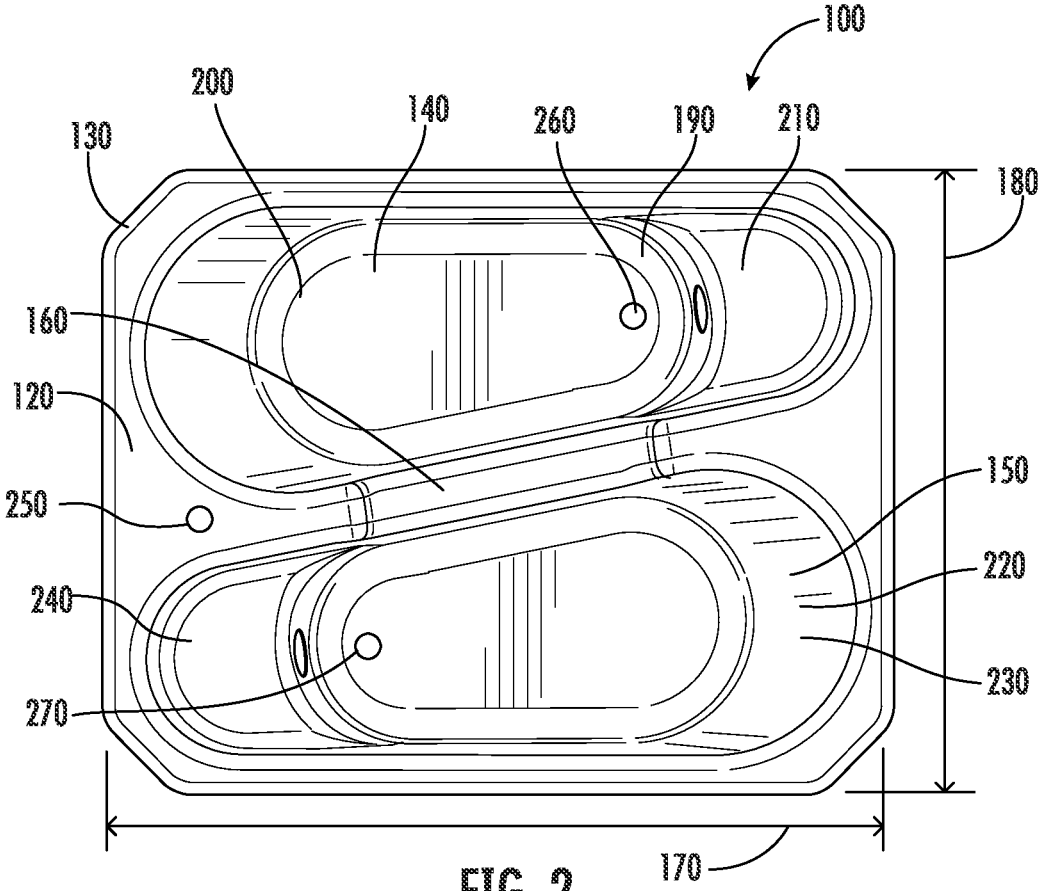
FIG. 2 is a top view of the bath system of FIG. 1, according to an exemplary embodiment.

Referring now to FIG. 2, a top view of the bath system 100 of FIG. 1 is shown. The bath system 100 may comprise a length, shown as bath system length 170, and a width, shown as bath system width 180. By way of example, the bath system length 170 and the bath system width 180 are the same dimension such that the bath system 100 is square or substantially square. In some embodiments, the bath system length 170 is greater than the bath system width 180. In still some embodiments, the bath system length 170 is less than the bath system width 180.

The first basin 140 may further be a hot water zone 190. The hot water zone 190 is configured to at least hold hot water within. In some embodiments, the hot water zone 190 may hold substances other than hot water (e.g., cold water, material, etc.). The hot water zone 190 may comprise a plurality of zones, shown as first deep zone 200 and first shallow zone 210. By way of example, the first deep zone 200 may have a larger area or volume than the first shallow zone 210. In some embodiments, the first shallow zone 210 may have a larger area or volume than the first deep zone 200. As can be appreciated, the user may sit in the first shallow zone 210 (e.g., using the base of the first shallow zone 210 as a chair) such that a portion of the user's body (e.g., arms, legs, etc.) may be disposed within the first deep zone 200.

The second basin 150 may further be a cold water zone 220. The cold water zone 220 is configured to at least hold cold water within. In some embodiments, the cold water zone 220 may hold substances other than cold water (e.g., hot water, material, etc.). The cold water zone 220 may comprise a plurality of zones, shown as second deep zone 230 and second shallow zone 240. By way of example, the second deep zone 230 may have a larger area or volume than the second shallow zone 240. In some embodiments, the second shallow zone 240 may have a larger area or volume than the second deep zone 230. As can be appreciated, the user may sit in the second shallow zone 240 (e.g., using the base of the second shallow zone 240 as a chair) such that a portion of the user's body (e.g., arms, legs, etc.) may be disposed within the second deep zone 230.

Figure 3:
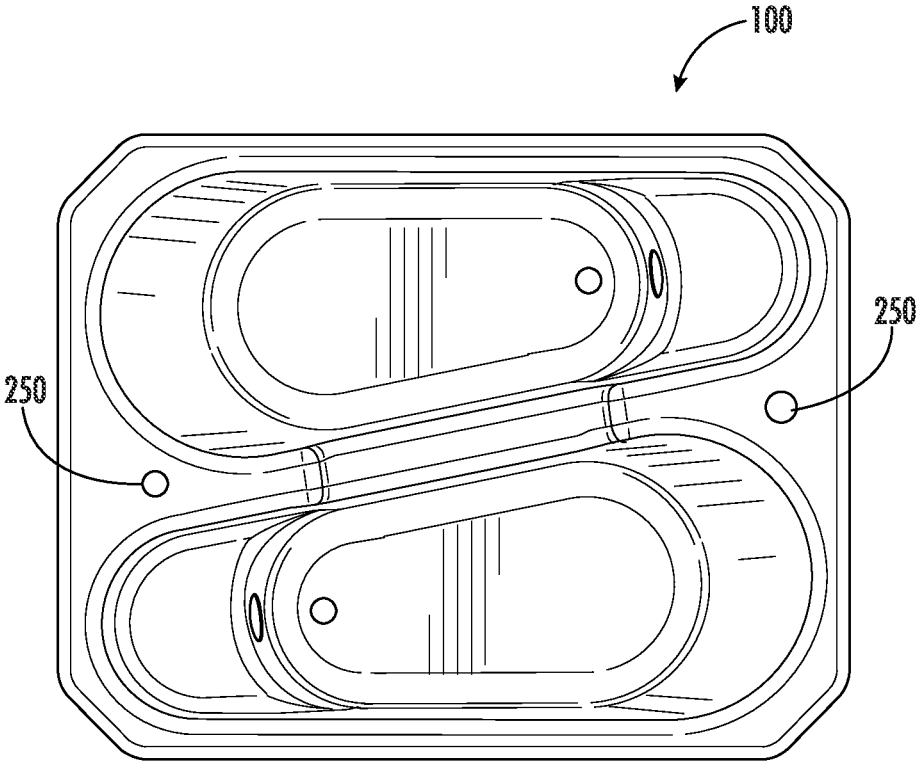
FIG. 3 is a top view of the bath system of FIG. 1, according to an exemplary embodiment.

The bath system 100 further comprises an inlet, shown as water inlet 250. Although not shown in the drawings, it is contemplated that water inlet 250 may include a faucet, nozzle, spout, tap, or any other hardware that can be operated (e.g., manually by a user or automatically by an actuator) to control the flow of water into one or both of the basins 140 and 150. By way of example, the water inlet 250 is positioned on the rim 120 between the set of basins 140 and 150. The water inlet 250 may be actuated by turning at least one of a hot water handle and a cold water handle. In some embodiments, the water being dispensed from the water inlet 250 may be a combination of both hot water and cold water. Hot water may be dispensed into the bath system 100 by actuating the hot water handle. Cold water may be dispensed into the bath system 100 by actuating the cold water handle. Hot and cold water mixing may occur upstream of the water inlet 250 in some embodiments. Alternatively, hot and cold water may be dispensed from separate water inlets 250. In some embodiments, both the hot water handle and the cold water handle are simultaneously actuated. As shown, the bath system 100 includes a single water inlet 250. In some embodiments, the bath system 100 may include an additional water inlet 250, positioned adjacent to the first water inlet 250 or spaced apart from the first water inlet 250, as shown in FIG. 3. The water inlet 250 may be a fixed inlet that is positioned over one of the first basin 140 and the second basin 150. In some embodiments, the water inlet 250 may be selectively repositionable over the first basin 140 and the second basin 150 by rotating the water inlet 250. In still some embodiments, the water inlet 250 may comprise a sensor disposed within, where the sensor may detect which basin the water inlet 250 is positioned over and dispense water, with a preset temperature, into one of the set of basins 140 and 150. It is contemplated that both of the water inlets 250 can dispense water at any temperature by selectively mixing hot and cold water upstream of the water inlets 250, or each of the water inlets 250 can be a dedicated hot water inlet or cold water inlet (e.g., one inlet for hot water and another for cold water) in various embodiments.

The hot water zone 190 further comprises an outlet, shown as hot water drain 260. The hot water drain 260 is disposed within the first deep zone 200 proximal to the first shallow zone 210. In some embodiments, the hot water drain 260 is positioned distal to the first shallow zone 210. The hot water drain 260 is configured to drain water out of the hot water zone 190. By way of example, a floor of the hot water zone 190 may be biased (e.g., sloped downward) towards the hot water drain 260. As shown, the hot water zone 190 includes a single hot water drain 260. In some embodiments, the hot water zone 190 further includes additional hot water drains 260 positioned around various locations of the hot water zone 190. The hot water drain 260 may include a stop that is configured to prevent water from exiting the hot water zone 190.

The cold water zone 220 further comprises an outlet, shown as cold water drain 270. The cold water drain 270 is disposed within the second deep zone 230 proximal to the second shallow zone 240. In some embodiments, the cold water drain 270 is positioned distal to the second shallow zone 240. The cold water drain 270 is configured to drain water out of the cold water zone 220. By way of example, a floor of the cold water zone 220 may be biased (e.g., sloped downward) towards the cold water drain 270. The floor of the cold water zone 220 may be sloped in an opposite direction compared to the slope of the hot water zone 190. As shown, the cold water zone 220 includes a single cold water drain 270. In some embodiments, the cold water zone 220 further includes additional cold water drains 270 positioned around various locations of the cold water zone 220. The cold water drain 270 may include a stop that is configured to prevent water from exiting the cold water zone 220.

By way of example, the hot water drain 260 and the cold water drain 270 are configured to be manual drains, where the user manually actuates the hot water drain 260 and the cold water drain 270 between an open position and a closed position. In some embodiments, the hot water drain 260 and the cold water drain 270 may be automatically actuated between the open positon and the closed position by a controller. In such an embodiment, the controller is operably coupled to at least one of the hot water drain 260 and the cold water drain 270 such that the controller may actuate at least one of the hot water drain 260 and the cold water drain 270 in response to a signal.

In some embodiments, the bath system 100 may include a single water inlet and a single drain. According to an exemplary embodiment, the water inlet 250 may be positioned above the hot water zone 190 and the cold water zone 220 may include the cold water drain 270. In such an embodiment, the water may flow from the hot water zone 190, above the partition 160, to the cold water zone 220 such to create a water pushing/pulling effect. In some embodiments, the water inlet 250 may be positioned above the cold water zone 220 and the hot water zone 190 may include the hot water drain 260.

Figure 4:
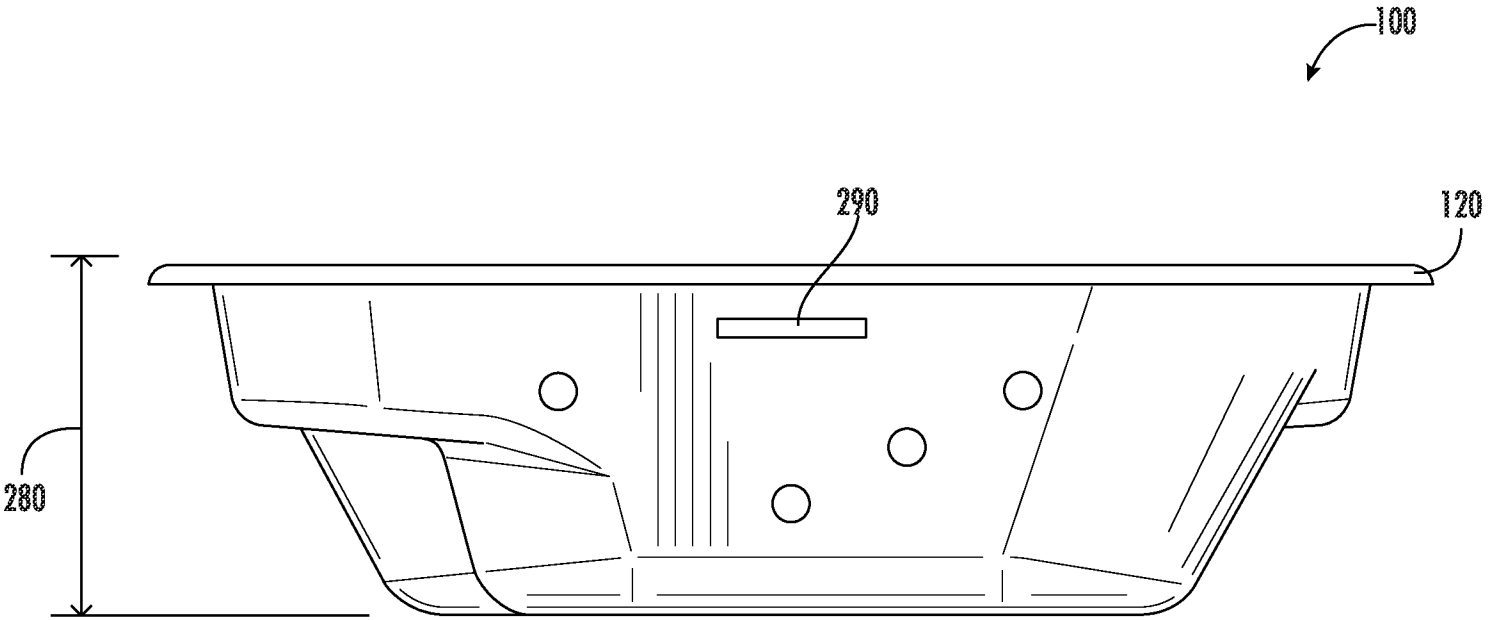
FIG. 4 is a side view of the bath system of FIG. 1, according to an exemplary embodiment.

Referring now to FIG. 4, a side view of the bath system 100 of FIG. 1 is shown. The bath system 100 may further comprise a height, shown as bath system height 280. The bath system height 280 is the distance between the floor of the set of basins 140 and 150 and the rim 120. By way of example, the bath system height 280 may be the height of the set of basins 140 and 150. The bath system 100 further comprises an overflow outlet, shown as overflow port 290. The overflow port 290 is configured to allow water to exit the set of basins 140 and 150 when the water level within the set of basins 140 and 150 approaches the top (e.g., reaches the height of the overflow port 290). The overflow port 290 may be positioned within the second basin 150, proximal to the rim 120. In some embodiments, the overflow port 290 may be positioned distal to the rim 120. In still some embodiments, the overflow port 290 may be positioned within the first basin 140. In still some embodiments, the overflow port 290 may be positioned in both the set of basins 140 and 150 (e.g., two overflow ports 290).

Figure 5:
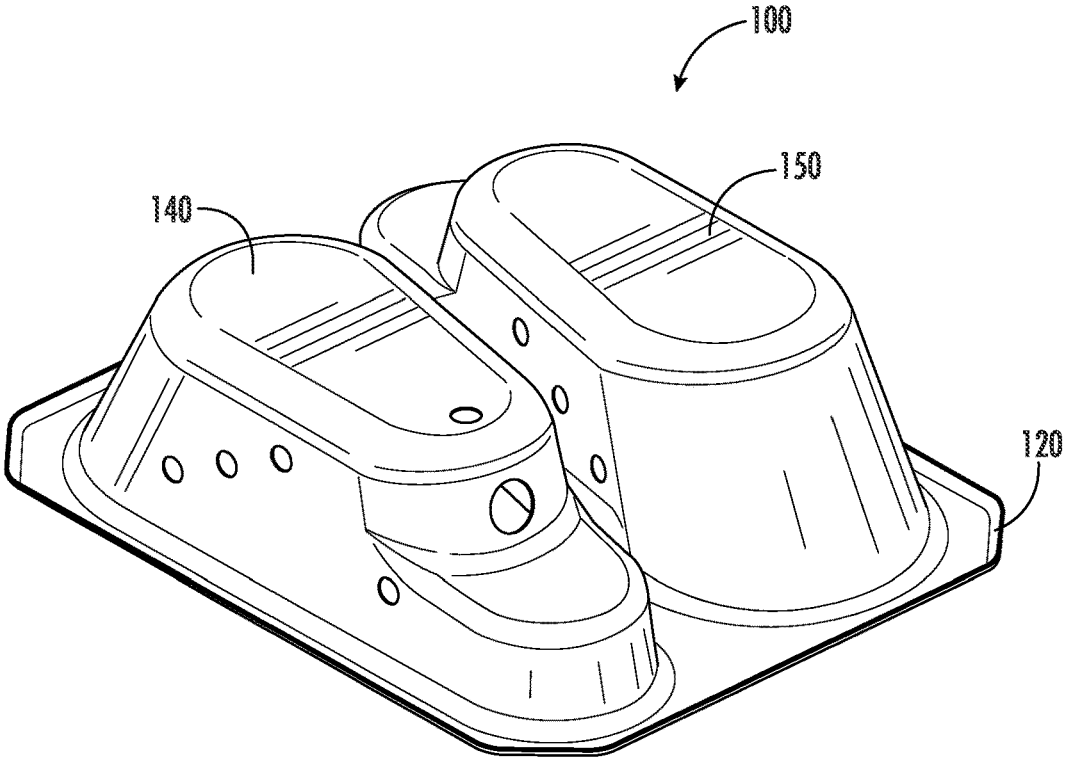
FIG. 5 is a perspective, bottom view of the bath system of FIG. 1, according to an exemplary embodiment.

Referring now to FIG. 5, a perspective, bottom view of the bath system 100 of FIG. 1 is shown. As shown, the bottom of the set of basins 140 and 150 may be substantially flat such to allow the set of basins 140 and 150 to sit flush with the ground on installation. To be more precise, at least one of the bottoms of the first deep zone 200, first shallow zone 210, second deep zone 230, and second shallow zone 240 may be substantially flat. In some embodiments, at least one of the bottoms of the first deep zone 200, first shallow zone 210, second deep zone 230, and second shallow zone 240 may rounded, sloped, or otherwise non-flat.

Figure 6:
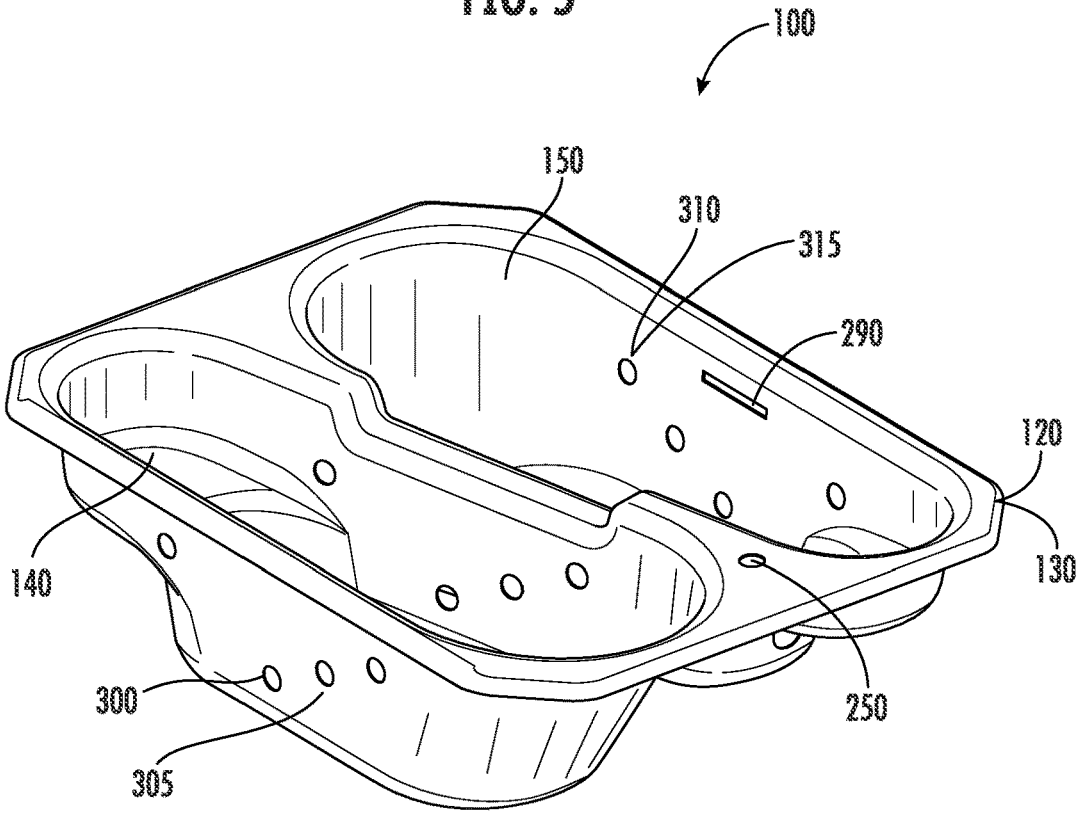
FIG. 6 is a perspective, top view of the bath system of FIG. 1, according to an exemplary embodiment.

Referring to FIG. 6, the bath system 100 further comprises a set of jet systems, shown as first whirlpool system 300 and second whirlpool system 310. The first whirlpool system 300 is coupled to the first basin 140. The first whirlpool system 300 may include a plurality of nozzles, jets, or the like, denoted as first whirlpool nozzles 305. The first whirlpool nozzles 305 may be disposed along both sides of the first basin 140. In some embodiments, the first whirlpool nozzles 305 may be disposed along one side of the first basin 140. The first whirlpool system 300 is configured to circulate the water within the first basin 140. In some embodiments, the first whirlpool system 300 may blow air into the first basin 140. By way of example, the first whirlpool system 300 circulates hot water within the first basin 140. The second whirlpool system 310 is coupled to the second basin 150. The second whirlpool system 310 may include a plurality of nozzles, jets, or the like, denoted as second whirlpool nozzles 315. The second whirlpool nozzles 315 may be disposed along both sides of the second basin 150. In some embodiments, the second whirlpool nozzles 315 may be disposed along one side of the second basin 150. The second whirlpool system 310 is configured to circulate the water within the second basin 150. In some embodiments, the second whirlpool system 310 may blow air into the second basin 150. By way of example, the second whirlpool system 310 circulates cold water with in the second basin 150. The first and second whirlpool nozzles 305, 315 may be configured to output water at an angle relative to the respective basin 140, 150.

Figure 7:
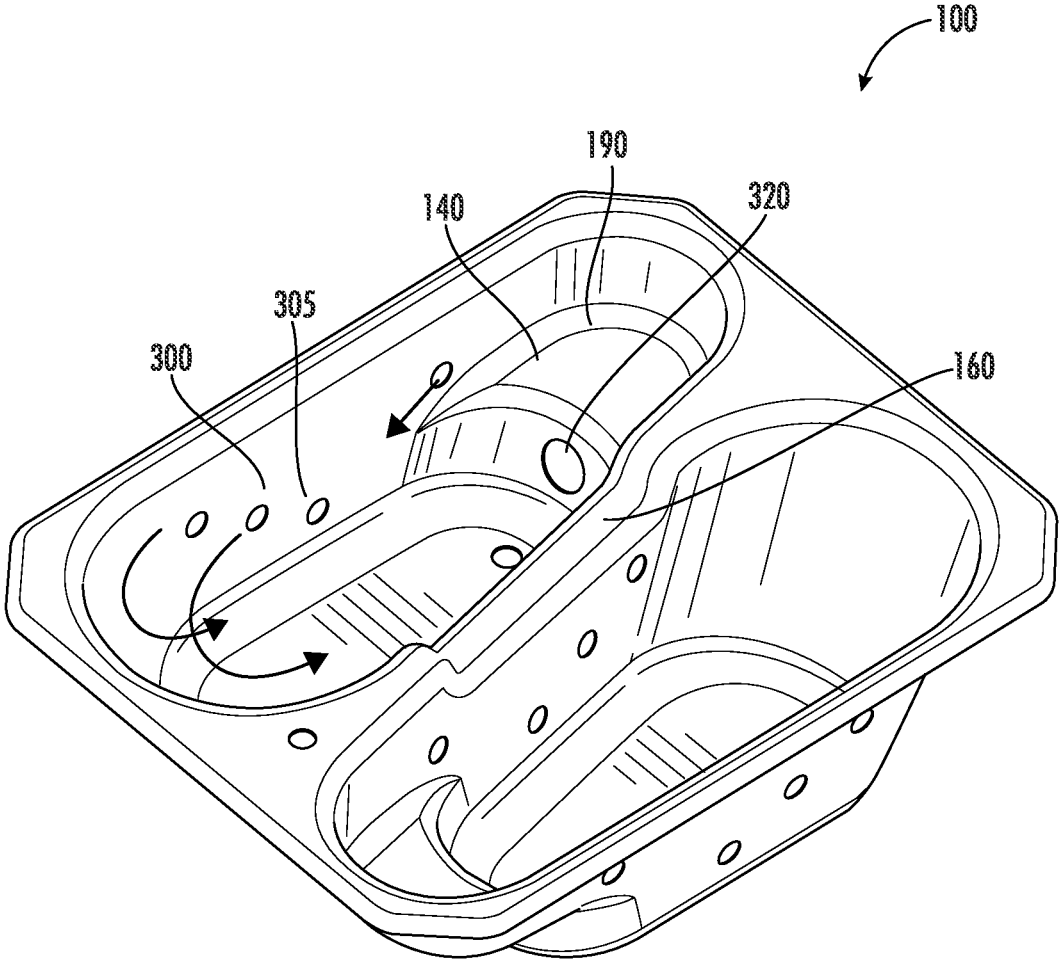
FIG. 7 is a perspective, top view of the bath system of FIG. 1 showing hot water circulation, according to an exemplary embodiment.

Referring now to FIG. 7, a perspective, top view of the bath system 100 of FIG. 1 showing hot water circulation is shown. The hot water zone 190 further comprises a suction port, shown as first suction system 320. The first suction system 320 is configured to suction water from the hot water zone 190 and circulate that water through a heating system, further described in FIG. 8. In some embodiments, the first suction system 320 may further include a filter system that is configured to filter out foreign particles (e.g., skin, hair, etc.). At least a portion of the water that is suctioned into the first suction system 320 may be circulated back into the hot water zone 190 through the first whirlpool nozzles 305. In some embodiments, at least a portion of the water that is suctioned into the first suction system 320 may not be circulated back into the hot water zone 190 and instead be routed into an overflow region. As shown, the hot water zone 190 is configured to be a rounded geometry. The rounded geometry of the hot water zone 190 makes it advantageous for the first whirlpool system 300 to circulate hot water within the hot water zone 190 such to eliminate development of stagnant water. As can be appreciated, the first whirlpool system 300 keeps the water disposed within the hot water zone 190 clean and warm with the circulation process.

Figure 8:
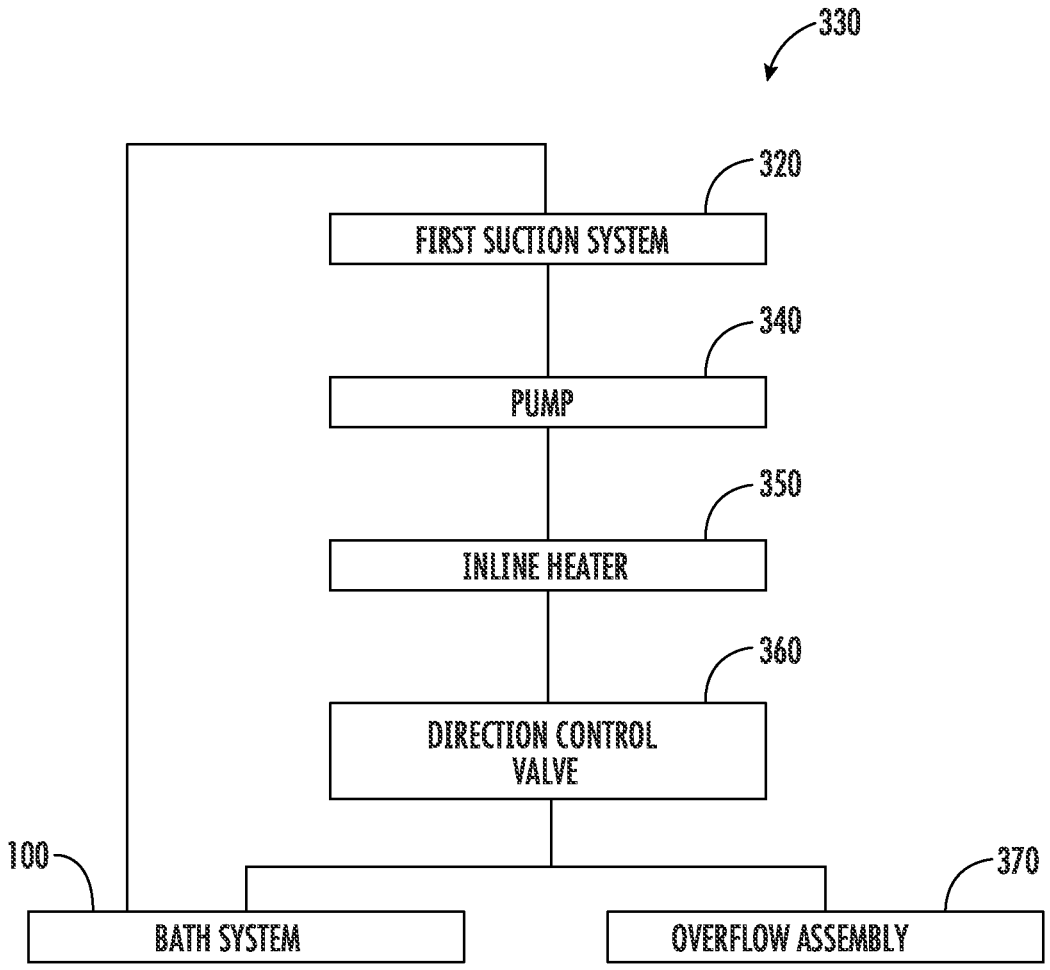
FIG. 8 is a block diagram showing the flow of hot water within the bath system of FIG. 1, according to an exemplary embodiment.

Referring to FIG. 8, a block diagram showing a hot water circulation system 330 is shown. The hot water circulation system 330 may further comprise a pump 340, an inline heater 350, a direction control valve 360, and an overflow assembly 370. Water that is suctioned through the first suction system 320 may be directed towards the pump 340. The pump 340 is configured to keep the water flowing through the hot water circulation system 330 by pumping water towards the inline heater 350. The inline heater 350 may be configured to heat the water coming from the pump 340 such to create hot water. In some embodiments, the pump 340 may direct water towards a different heating element (e.g., phase change material, surface heating, etc.). Once water passes through the inline heater 350, the water goes to the direction control valve 360. At the direction control valve 360, the water may flow back to the bath system 100 or to the overflow assembly 370. The direction control valve 360 is configured to direct the water flowing the hot water circulation system 330. In some embodiments, the direction control valve 360 may direct water away based on the volume of water present in the bath system 100 such to prevent overflow. In still some embodiments, the direction control valve 360 may direct water based on the temperature of the water flow through the hot water circulation system 330. Water that flows to bath system 100 passes through the first whirlpool nozzles 305 as hot water. Water that does not flow back to the bath system 100 flows towards the overflow assembly 370 where the water may drain from the bath system 100. According to an exemplary embodiment, the hot water circulation system 330 may further comprise additional circulation accessories (e.g., filtration system, water reservoir, etc.) positioned in a plurality of positions along the hot water circulation system 330.

Figure 9:
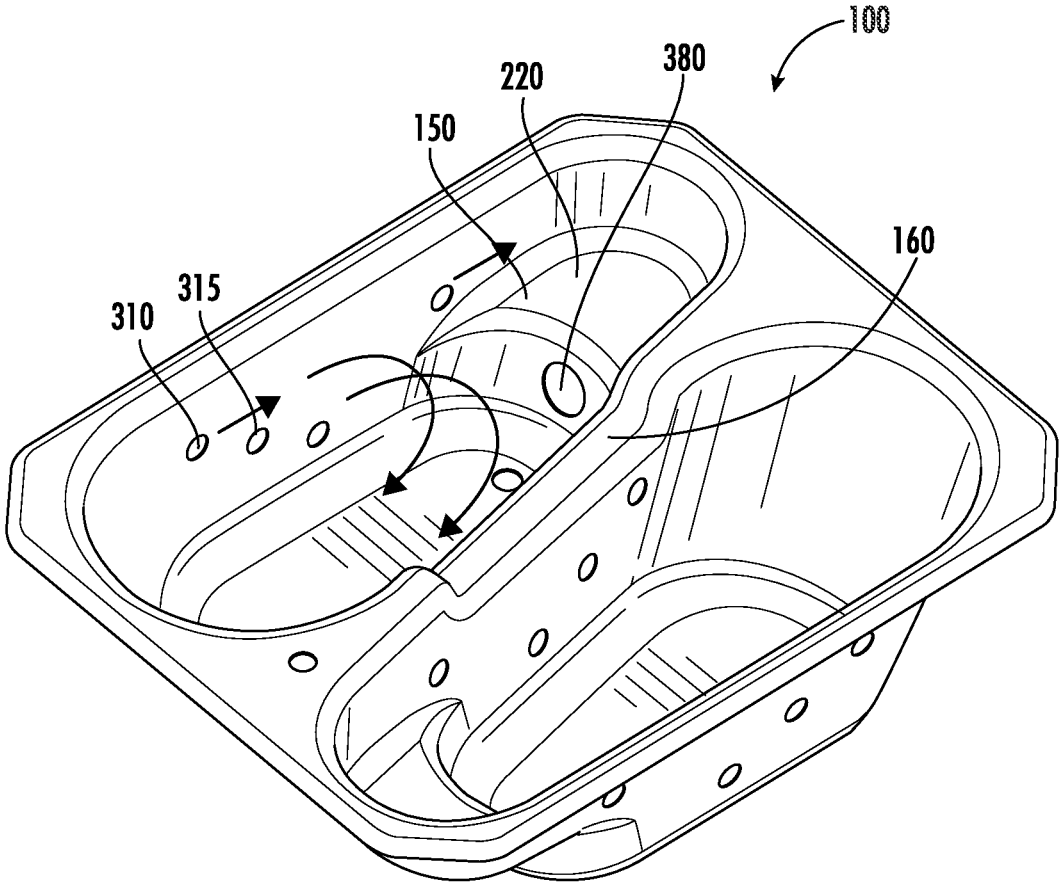
FIG. 9 is a perspective, top view of the bath system of FIG. 1 showing cold water circulation, according to an exemplary embodiment.

Referring now to FIG. 9, a perspective, top view of the bath system 100 of FIG. 1 showing cold water circulation is shown. The cold water zone 220 further comprises a suction port, shown as second suction system 380. The second suction system 380 is configured to suction water from the cold water zone 220 and circulate that water through a cooling system, further described in FIG. 10. In some embodiments, the second suction system 380 may further include a filter system that is configured to filter out foreign particles (e.g., skin, hair, etc.). At least a portion of the water that is suctioned into the second suction system 380 may be blown back into the cold water zone 220 through the second whirlpool nozzles 315. In some embodiments, at least a portion of the water that is suctioned into the second suction system 380 may not be blown back into the cold water zone 220 and instead be routed into an overflow region. As shown, the cold water zone 220 is configured to be a rounded geometry. The rounded geometry of the cold water zone 220 makes it advantageous for the second whirlpool system 310 to circulate hot water within the cold water zone 220 such to eliminate stagnant water. As can be appreciated, the second whirlpool system 310 keeps the water disposed within the cold water zone 220 clean and warm with the circulation process.

Figure 10:
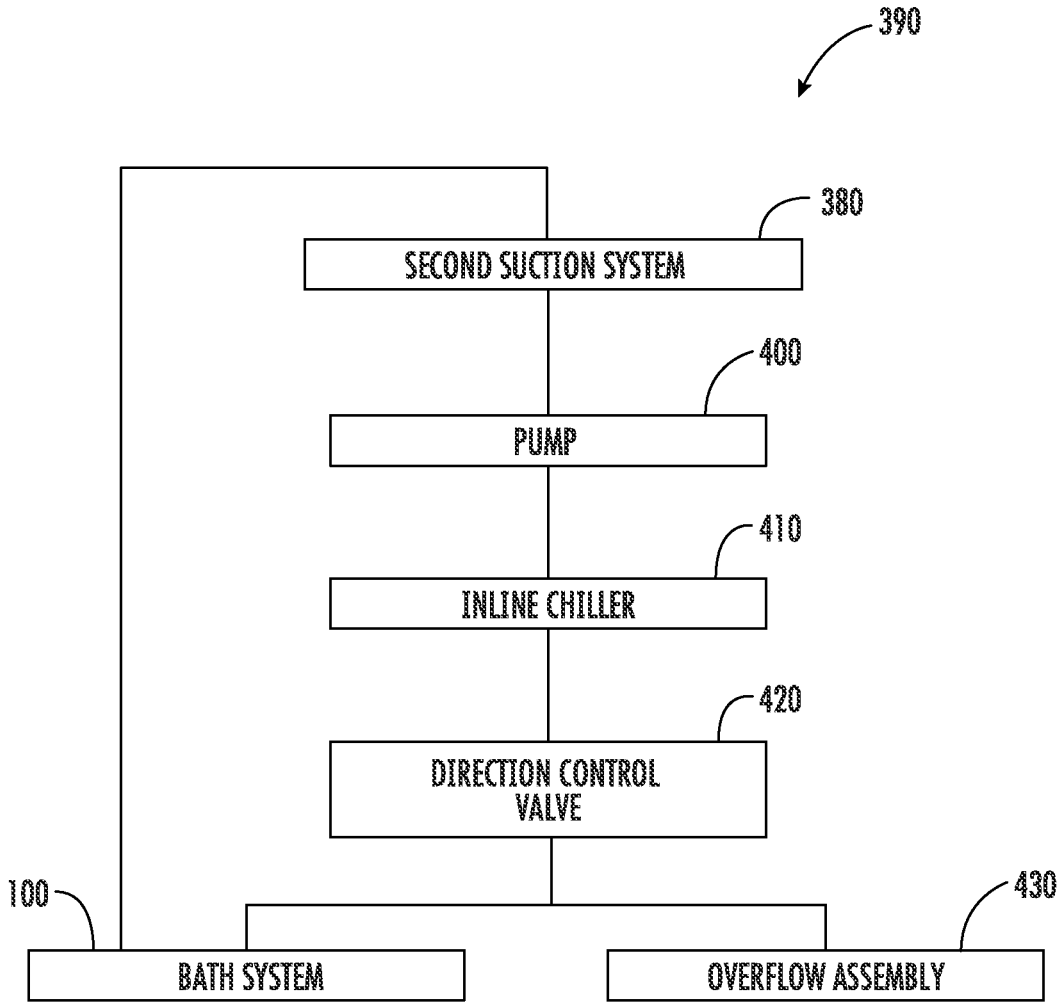
FIG. 10 is a block diagram showing the flow of cold water within the bath system of FIG. 1, according to an exemplary embodiment.

Referring to FIG. 10, a block diagram showing a cold water circulation system 390 is shown. The cold water circulation system 390 may further comprise a pump 400, an inline chiller 410, a direction control valve 420, and an overflow assembly 430. Water that is suctioned through the second suction system 380 may be directed towards the pump 400. The pump 400 is configured to keep the water flowing through the cold water circulation system 390 by pumping water towards the inline chiller 410. The inline chiller 410 may be configured to cool the water coming from the pump 400 such to create cold water. In some embodiments, the pump 400 may direct water towards a different cooling element (e.g., phase change material, surface cooling, etc.). Once water passes through the inline chiller 410, the water goes to the direction control valve 420. At the direction control valve 420, the water may flow back to the bath system 100 or to the overflow assembly 430. The direction control valve 420 is configured to direct the water flowing the cold water circulation system 390. In some embodiments, the direction control valve 420 may direct water away based on the volume of water present in the bath system 100 such to prevent overflow. In still some embodiments, the direction control valve 420 may direct water based on the temperature of the water flow through the cold water circulation system 390. Water that flows to bath system 100 passes through the second whirlpool nozzles 315 as cold water. Water that does not flow back to the bath system 100 may flow towards the overflow assembly 430 where the water may drain from the bath system 100. According to an exemplary embodiment, the cold water circulation system 390 may further comprise additional circulation accessories (e.g., filtration system, water reservoir, etc.) positioned in a plurality of positions along the cold water circulation system 390.

The water positioned above the partition 160 may be a mixture of hot water and cold water. To be more precise, the water positioned above the partition 160 may be described as "intermediate water" having an intermediate temperature. In some embodiments, the hot and cold water circulation previously described is limited to the hot and cold water within the portions of the basins 140 and 150 below the partition 160 and does not cause substantial movement or circulation of the intermediate water located above the partition 160. For example, the nozzles and the suction may be oriented to cause the flow of water in a substantially horizontal circulation pattern below the partition 160 that does not substantially mix with the intermediate water above the partition 160. In some embodiments, the intermediate water may have circulation between the set of basins 140 and 150. In still some embodiments, the bath system 100 may not include a partition 160. In such an embodiment, at least one of the hot water circulation system 330 and the cold water circulation system 390 may output water at an increasing flow rate such to lower the chance of the hot and cold water mixing.

In some embodiments, the bath system 100 may further comprise insulation. The insulation may be positioned along the outside of the bath system 100 such to insulate a portion of the bath system 100. In some embodiments, insulation may be placed between the set of basins 140 and 150 (e.g., within the partition 160). The insulation may be any of blown insulation, foam insulation, fiberglass insulation, cellulose insulation or the like. The insulation may further surround at least one of the inline heater 350 and the inline chiller 410.

The water flowing within both the hot water zone 190 and the cold water zone 220 are configured to flow in opposite directions. For example, the water within the hot water zone 190 may flow in the clockwise direction and the water within the cold water zone 220 may flow in the counterclockwise direction. The flow rate of the water within the respective hot water zone 190 and cold water zone 220 are configured to have a flow rate high enough to prevent the water from mixing over the partition 160. In some embodiments, the water does not mix over the partition 160 due to the hot water and cold water having different density (e.g., the density of water varies based on temperature).

As can be appreciated, the respective hot water zone 190 and cold water zone 220 may maintain consistent hot and cold water temperatures. The user may easily transition between the hot water zone 190 and the cold water zone 220 such to create a therapeutic effect. To be more precise, the user may consistently transition between hot and cold water to perform a process similar to contrast bath therapy. Contrast bath therapy utilizes the process of consistent hot and cold water circulation such to increase blood flow within the body. In some embodiments, the user may alter at least one of the hot water circulation system 330 and the cold water circulation system 390 to change the flow rate of the water circulation. In such an embodiment, the user may change the water temperature in at least one of the first basin 140 and the second basin 150 such to create a similar therapeutic effect.

Figure 11:
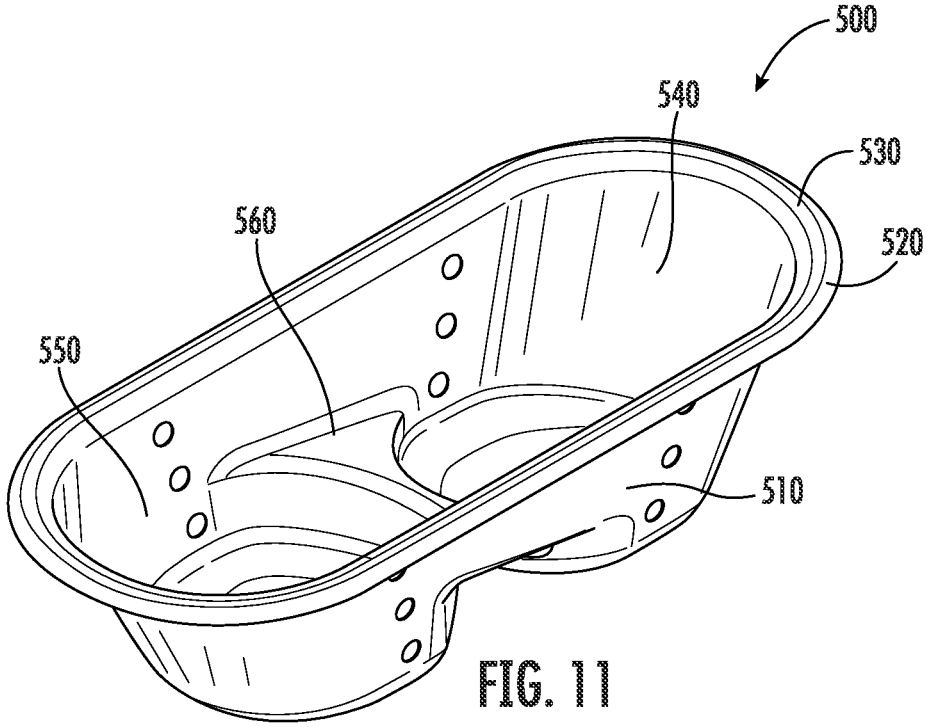
FIG. 11 is a perspective view of a bath system, according to an exemplary embodiment.

Referring to FIG. 11, a perspective view of a bath system 500 is shown, according to various exemplary embodiments. The bath system 500 is configured to be substantially similar to the bath system 100 such that similar reference numerals may be used to describe the bath system 500. The bath system 500 may comprise a plurality of sidewalls 510 positioned around the perimeter of the bath system 500. By way of example, the bath system 500 includes four sidewalls 510, where the plurality of sidewalls 510 are positioned adjacent to one another. In some embodiments, the bath system 500 may include any number of sidewalls 510 positioned in various locations around the bath system 500. The sidewalls 510 may be continuous (e.g., connected to each other) or broken (e.g., gaps between adjacent sidewalls 510 or within a single sidewall 510) and may define the structure shown in FIG. 11. The bath system 500 may further include a rim 520 disposed along the top of the bath system 500 and coupled to at least one of the plurality of sidewalls 510. The rim 520 may be configured to support some or all of the weight of the bath system 500 (e.g., hanging from the rim 120) and can be characterized as a support rim 520, where the rim 520 interfaces with a mounting surface (e.g., tile, granite, wood, etc.) when the bath system 500 is mounted into a bathing environment (e.g., bathroom, etc.). The plurality of sidewalls 510 abut one another at corners, shown as radius portion 530. The radius portion 530 may be a substantially curved portion that couples one sidewall 510 to another. In some embodiments, the radius portion 530 may be a flat portion positioned between at least two of the plurality of sidewalls 510. By way of example, the bath system 500 may comprise two radius portions 530, positioned adjacent to one another along the perimeter of the bath system 500.

The bath system 500 may further include a set of basins, shown as first basin 540 and second basin 550. The set of basins 540 and 550 may be coupled to at least a portion of the rim 520. The set of basins 540 and 550 may be configured to be cylindrical basins. As can be appreciated, cylindrical basins promote water circulation within the set of basins 540 and 550. In some embodiments, the set of basins 540 and 550 may be configured to be circular basins. In some embodiments the set of basins 540 and 550 may have any geometrical configuration (e.g., any shape or structure), including the configuration shown in FIG. 11. Positioned between the set of basins 540 and 550 is a divider, shown as partition 560. The partition 560 may be a divider disposed along a portion of a height of the bath system 500 (e.g., extending form the bottom to the top of the bath system 500). In some embodiments, the partition 560 may be disposed along the entire height of the bath system 500, or along a portion of the height (e.g., extending partially form the bottom to the top of the bath system 500). In still some embodiments, the partition 560 may prevent the transition of water between the set of basins 540 and 550. By way of example, the partition 560 may be disposed along the height of the bath system that makes it advantageous for the user to easily transition between the set of basins 540 and 550 without allowing excess water to transition between the set of basins 540 and 550. In still some embodiments, the bath system 500 may not include a partition 560. The partition 560 may further be configured to be positioned angular within the bath system 500. To be more precise, the partition 560 is configured to have varying heights such to create a slope from the second basin 550 to the first basin 540. In some embodiments, the partition 560 is configured to slope from the first basin 540 to the second basin 550. For example, the partition 560 may include a recess extending downward form the top of the bath system 500 that allows the user to move between the basins 540 and 550 without needing to elevate fully to the top of the bath system 500. In still some embodiments, the partition 560 may be substantially flat, where the partition is parallel to the rim 520.

Figure 12:
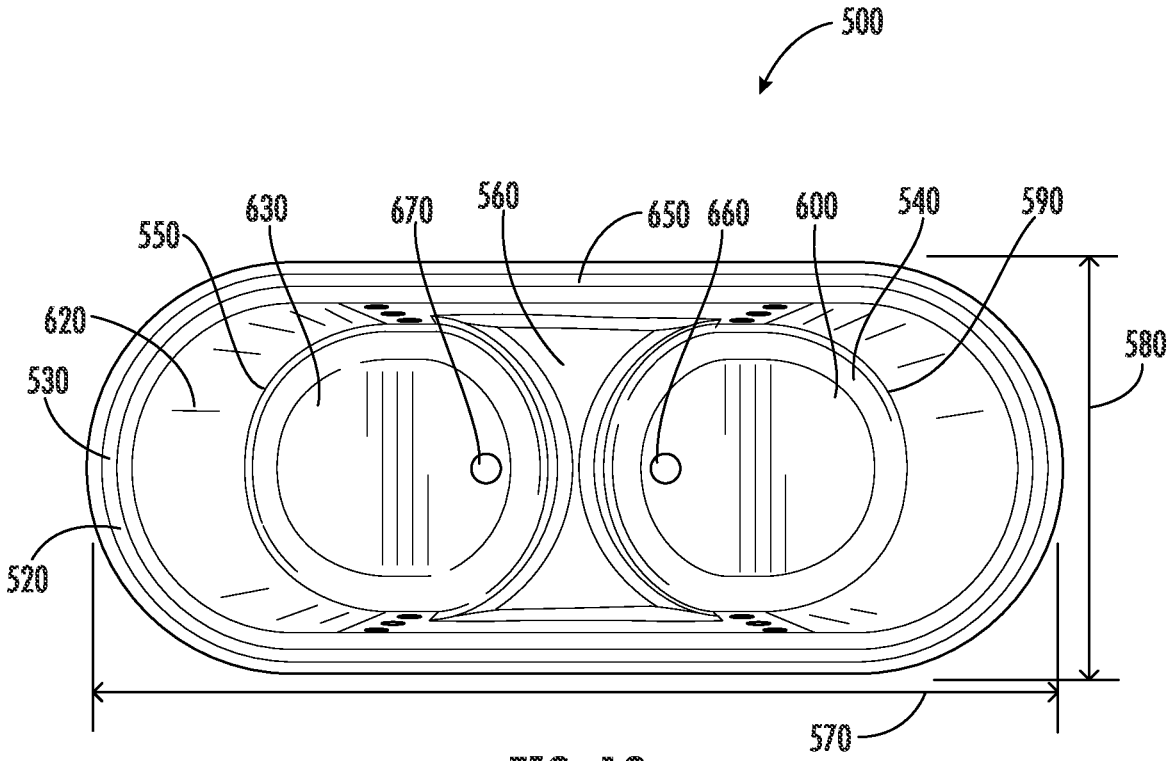
FIG. 12 is a top view of the bath system of FIG. 11, according to an exemplary embodiment.

Referring now to FIG. 12, a top view of the bath system 500 of FIG. 11 is shown. The bath system 500 may comprise a length, shown as bath system length 570, and a width, shown as bath system width 580. By way of example, the bath system length 570 is configured to be greater than the bath system width 580 such that the bath system 500 is rectangular in shape. In some embodiments, the bath system length 570 is the same as the bath system width 580. In still some embodiments, the bath system length 570 is less than the bath system width 580.

The first basin 540 may further be described as a hot water zone 590. The hot water zone 590 is configured to at least hold hot water within. In some embodiments, the hot water zone 590 may hold substances other than hot water (e.g., cold water, material, etc.). The hot water zone 590 further comprises a deep portion, shown as first deep zone 600. The first deep zone 600 is configured to be a deep portion disposed within the entire hot water zone 590. In some embodiments, the hot water zone 590 may comprise additional zones, where the additional zones may be of varying depths. As can be appreciated, the user may sit in the hot water zone 590 such that a portion of the user's body (e.g., arms, legs, etc.) may be disposed within the hot water zone 590. In some embodiments, the user may stand in the hot water zone 590 such that a lower portion of the user's body (e.g., legs, feet, etc.) may be disposed within the hot water zone 590. The second basin 550 may further be described as a cold water zone 620. The cold water zone 620 is configured to at least hold cold water within. In some embodiments, the cold water zone 620 may not hold cold water (e.g., hot water, material, etc.). The cold water zone 620 further comprises a deep portion, shown as second deep zone 630. The second deep zone 630 is configured to be a deep portion disposed within the entire cold water zone 620. In some embodiments, the cold water zone 620 may comprise additional zones, where the additional zones may be of varying depths. As can be appreciated, the user may sit in the second shallow zone 640 such that the portion of the user's body may be disposed within the second deep zone 630.

The bath system 500 further comprises an inlet, shown as water inlet 650. Although not shown in the drawings, it is contemplated that water inlet 650 may include a faucet, nozzle, spout, tap, or any other hardware that can be operated (e.g., manually by a user or automatically by an actuator) to control the flow of water into one or both of the basins 540 and 550. By way of example, the water inlet 650 is positioned on the rim 520 between the set of basins 540 and 550. The water inlet 650 may be actuated by turning at least one of a hot water handle and a cold water handle. In some embodiments, the water being dispensed from the water inlet 650 may be a combination of both hot water and cold water. Hot water may be dispensed into the bath system 500 by actuating the hot water handle. Cold water may be dispensed into the bath system 500 by actuating the cold water handle. Hot and cold water mixing may occur upstream of the water inlet 650 in some embodiments. Alternatively, hot and cold water may be dispensed from the separate water inlets 650. In some embodiments, both the hot water handle and the cold water handle are simultaneously actuated.

As shown, the bath system 500 includes a single water inlet 650. In some embodiments, the bath system 500 may include an additional water inlet 650, positioned adjacent to the first water inlet 650 or spaced apart from the first water inlet 650. The water inlet 650 may be a fixed inlet that is positioned over one of the first basin 540 and the second basin 550. In some embodiments, the water inlet 650 may be selectively repositionable over the first basin 540 and the second basin 550 by rotating the water inlet 650. In still some embodiments, the water inlet 650 may comprise a sensor disposed within, where the sensor may detect which basin the water inlet 650 is positioned over and dispose water, with a preset temperature, into one of the set of basins 540 and 550. It is contemplated that both of the water inlets 650 can dispense water at any temperature by selectively mixing hot and cold water upstream of the water inlets 650, or each of the water inlets 650 can be a dedicated hot water or cold water inlet (e.g., one inlet for hot water and another for cold water) in various embodiments.

The hot water zone 590 further comprises an outlet, shown as hot water drain 660. The hot water drain 660 is disposed within the first deep zone 600 proximal to the partition 560. In some embodiments, the hot water drain 660 is positioned distal to the partition 560. The hot water drain 660 is configured to drain water out of the hot water zone 590. By way of example, a floor of the hot water zone 590 may be biased towards the hot water drain 660. As shown, the hot water zone 590 includes a single hot water drain 660. In some embodiments, the hot water zone 590 further includes additional hot water drains 660 positioned around various locations of the hot water zone 590. The hot water drain 660 may include a stop that is configured to prevent water from exiting the hot water zone 590. The cold water zone 620 further comprises an outlet, shown as cold water drain 670. The cold water drain 670 is disposed within the second deep zone 630 proximal to the partition 560. In some embodiments, the cold water drain 670 is positioned distal to the partition 560. The cold water drain 670 is configured to drain water out of the cold water zone 620. By way of example, a floor of the cold water zone 620 may be biased towards the cold water drain 670.

As shown, the cold water zone 620 includes a single cold water drain 670. In some embodiments, the cold water zone 620 further includes additional cold water drains 670 positioned around various locations of the cold water zone 620. The cold water drain 670 may include a stop that is configured to prevent water from exiting the cold water zone 620. By way of example, the hot water drain 660 and the cold water drain 670 are configured to be manual drains, where the user manually actuates the hot water drain 660 and the cold water drain 670 between an open position and a closed position. In some embodiments, the hot water drain 660 and the cold water drain 670 may be automatically actuated between the open positon and the closed position by a controller. In such an embodiment, the controller is operably coupled to at least one of the hot water drain 660 and the cold water drain 670 such that the controller may actuate at least one of the hot water drain 660 and the cold water drain 670 in response to a signal.

In some embodiments, the bath system 500 may include a single water inlet and a single drain. According to an exemplary embodiment, the water inlet 650 may be positioned above the hot water zone 590 and the cold water zone 620 may include the cold water drain 670. In such an embodiment, the water may flow from the hot water zone 590 to the cold water zone 620 such to create a water pushing/pulling effect. In some embodiments, the water inlet 650 may be positioned above the cold water zone 620 and the hot water zone 590 may include the hot water drain 660.

Figure 13:
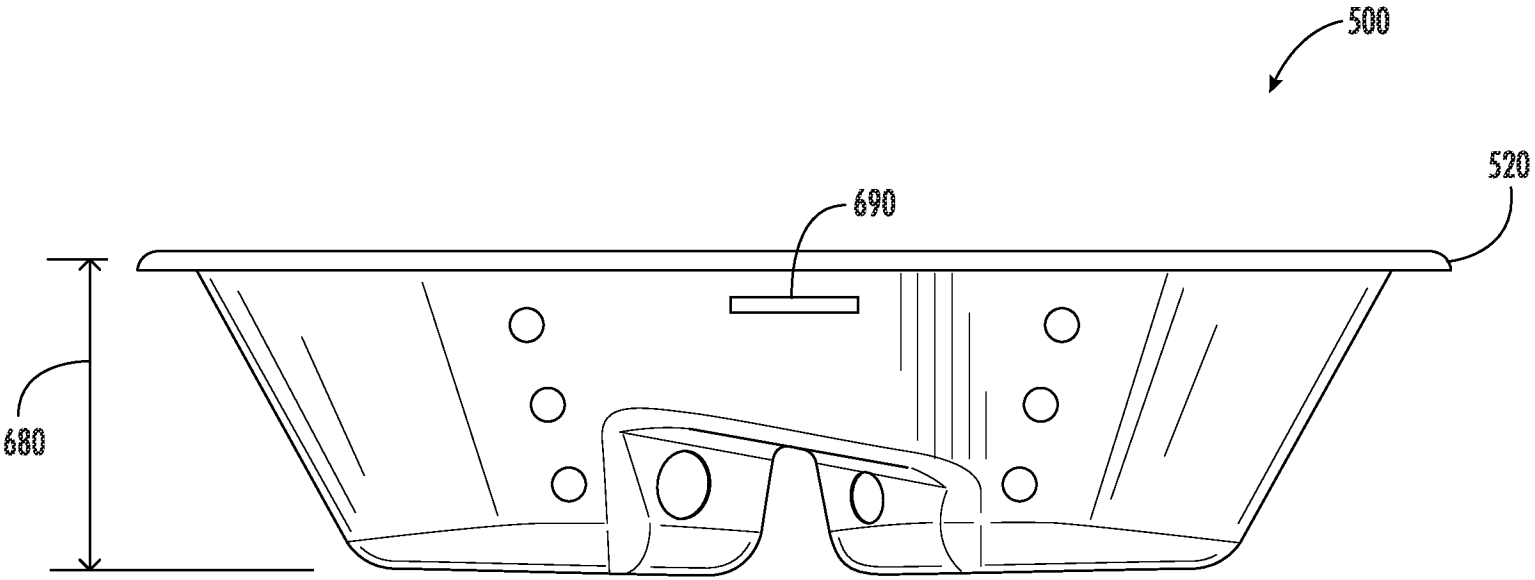
FIG. 13 is a side view of the bath system of FIG. 11, according to an exemplary embodiment.

Referring now to FIG. 13, a side view of the bath system 500 of FIG. 11 is shown. The bath system 500 may further comprise a height, shown as bath system height 680. The bath system height 680 is configured to be the distance between the floor of the set of basins 540 and 550 to the rim 520. By way of example, the bath system height 680 may be the height of the set of basins 540 and 550. The bath system 500 further comprises an overflow outlet, shown as overflow port 690. The overflow port 690 is configured to allow water to exit the set of basins 540 and 550 when the water level within the set of basins 540 and 550 reaches the top. The overflow port 690 is configured to be positioned within the second basin 550, proximal to the rim 520. In some embodiments, the overflow port 690 may be positioned distal to the rim 520. In still some embodiments, the overflow port 690 may be positioned within the first basin 540. In still some embodiments, the overflow port 690 may be positioned in both the set of basins 540 and 550.

Figure 14:
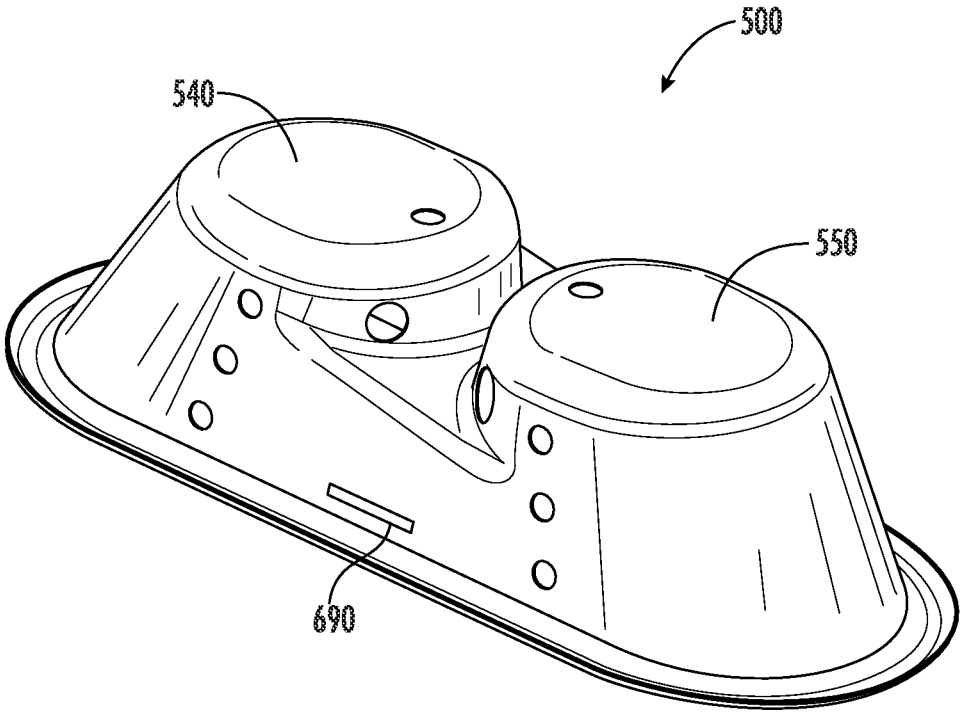
FIG. 14 is a perspective, bottom view of the bath system of FIG. 11, according to an exemplary embodiment.

Referring now to FIG. 14, a perspective, bottom view of the bath system 500 of FIG. 11 is shown. As shown, the bottom of the set of basins 540 and 550 are configured to be substantially flat such to allow the set of basins 540 and 550 to sit flush with the ground on installation. To be more precise, at least one of the bottoms of the first deep zone 600 and second deep zone 630 are configured to be substantially flat. In some embodiments, at least one of the bottoms of the first deep zone 600 and second deep zone 630 may be configured to be rounded.

Figure 15:
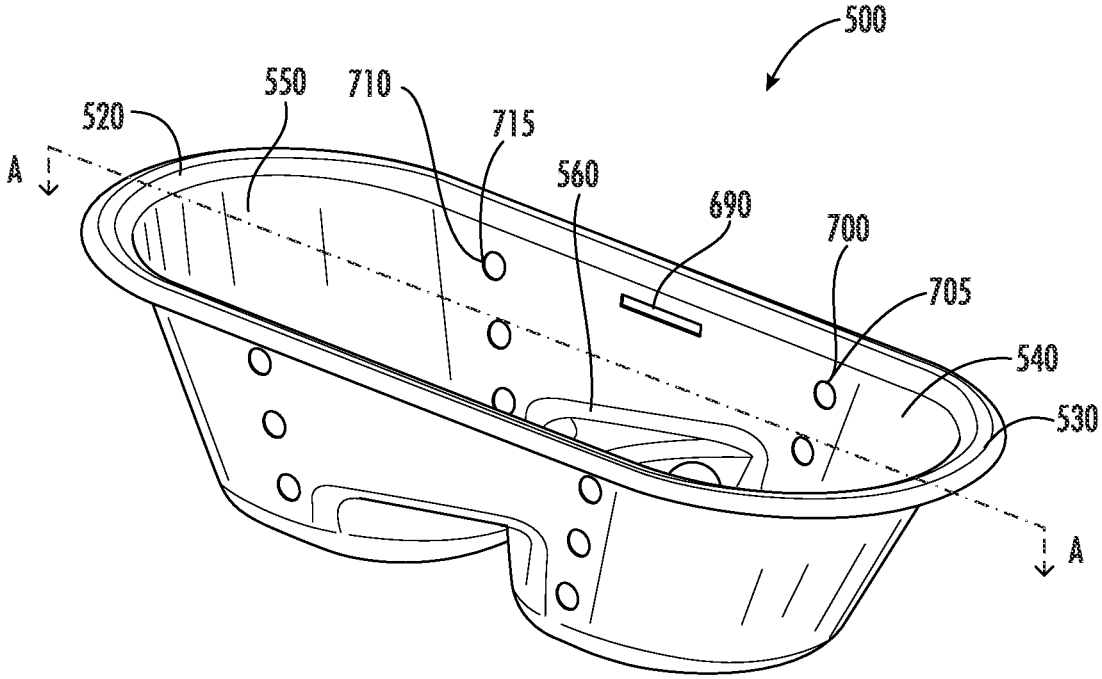
FIG. 15 is a perspective, top view of the bath system of FIG. 11, according to an exemplary embodiment.
Figure 16:
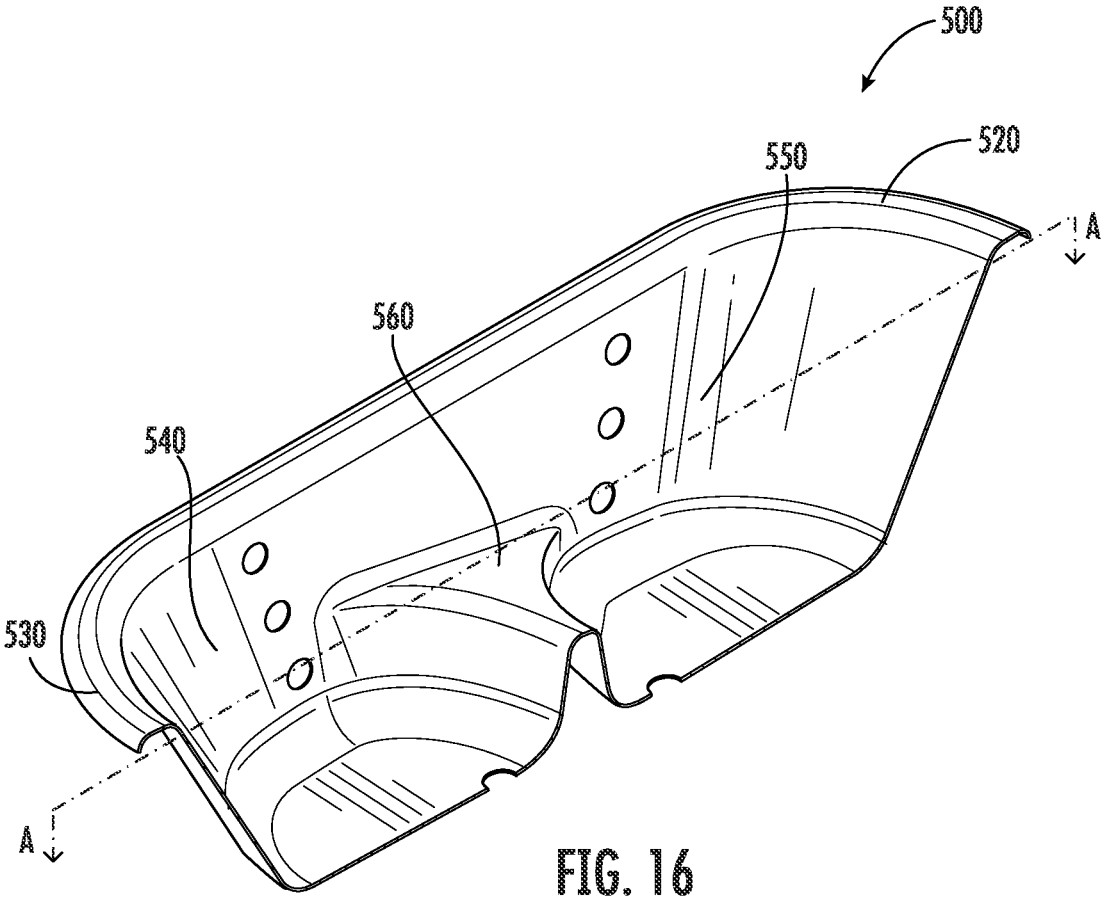
FIG. 16 is a perspective view of section AA of the bath system of FIG. 15, according to an exemplary embodiment.

Referring to FIGS. 15 and 16, the bath system 500 further comprises a set of jet systems, shown as first whirlpool system 700 and second whirlpool system 710. The first whirlpool system 700 is coupled to the first basin 540. Although not shown in the drawings, the first whirlpool system 700 may include a plurality of nozzles, shown as first whirlpool nozzles 705. The first whirlpool nozzles 705 may be disposed along both sides of the first basin 540. In some embodiments, the first whirlpool nozzles 705 may be disposed along one side of the first basin 540. The first whirlpool system 700 is configured to circulate the water within the first basin 540. In some embodiments, the first whirlpool system 700 may circulate air into the first basin 540. By way of example, the first whirlpool system 700 circulates hot water within the first basin 540. The second whirlpool system 710 is coupled to the second basin 550. The second whirlpool system 710 may include a plurality of nozzles, denoted as second whirlpool nozzles 715. The second whirlpool nozzles 715 may be disposed along both sides of the second basin 550. In some embodiments, the second whirlpool nozzles 715 may be disposed along one side of the second basin 550. The second whirlpool system 710 is configured to circulate the water within the second basin 550. In some embodiments, the second whirlpool system 710 may circulate air into the second basin 550. By way of example, the second whirlpool system 710 circulates cold water with in the second basin 550. Referring specifically to FIG. 16, the bath system 500 may be configured to have a substantially thin sidewall 510 such to allow insulation to be disposed along the perimeter of the bath system 500. In some embodiments, the bath system 500 may include an outer portion where the bath system 500 is positioned within. In such an embodiment, the cross section of the bath system 500 may be thicker such to provide greater structural rigidity to the bath system 500.

Figure 17:
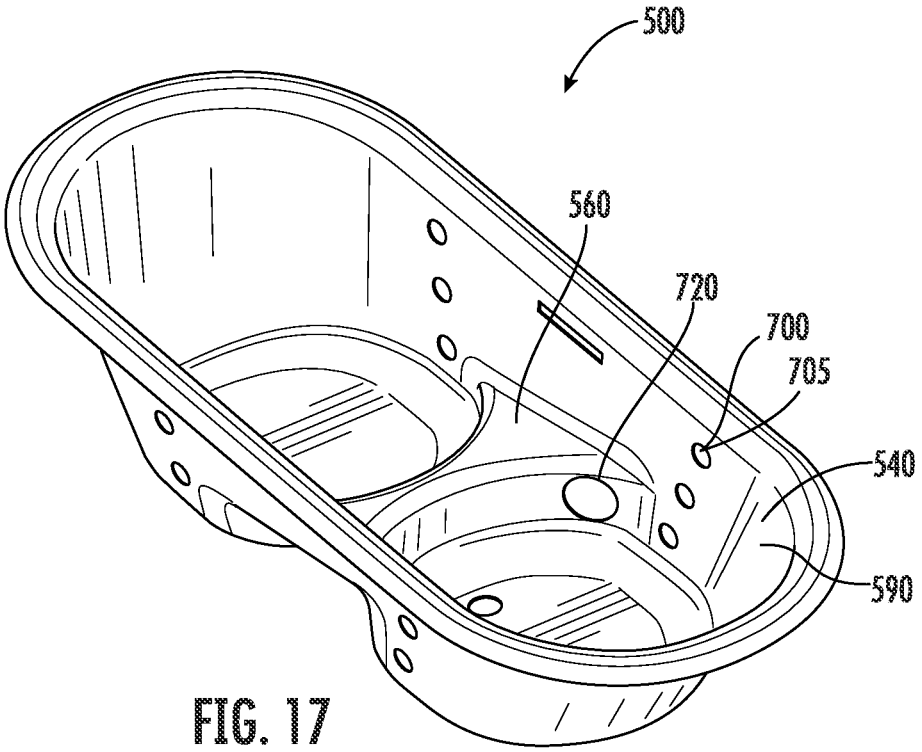
FIG. 17 is a perspective, top view of the bath system of FIG. 11 showing hot water circulation, according to an exemplary embodiment.

Referring now to FIG. 17, a perspective, top view of the bath system 500 of FIG. 11 showing hot water circulation is shown. The hot water zone 590 further comprises a suction port, shown as first suction system 720. The first suction system 720 is configured to suction water from the hot water zone 590 and circulate that water through a heating system, further described in FIG. 8. In some embodiments, the first suction system 720 may further include a filter system that is configured to filter out foreign particles (e.g., skin, hair, etc.). At least a portion of the water that is suctioned into the first suction system 720 may be blown back into the hot water zone 590 through the first whirlpool nozzles 705. In some embodiments, at least a portion of the water that is suctioned into the first suction system 720 may not be blown back into the hot water zone 590 and instead be routed into an overflow region. As shown, the hot water zone 590 is configured to be a rounded geometry. The rounded geometry of the hot water zone 590 makes it advantageous for the first whirlpool system 700 to circulate hot water within the hot water zone 590 such to eliminate development of stagnant water. As can be appreciated, the first whirlpool system 700 keeps the water disposed within the hot water zone 590 clean and warm with the circulation process.

Figure 18:
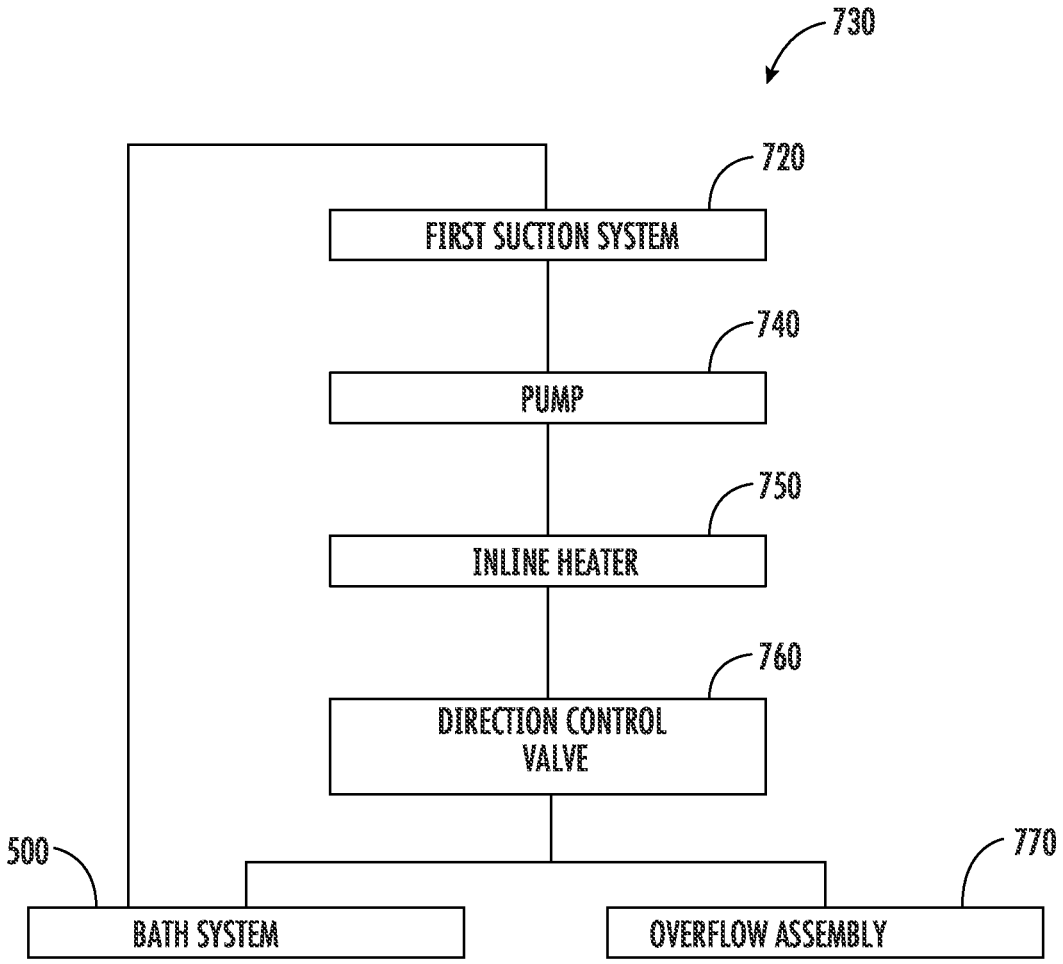
FIG. 18 is a block diagram showing the flow of hot water within the bath system of FIG. 11, according to an exemplary embodiment.

Referring to FIG. 18, a block diagram showing a hot water circulation system 730 is shown. The hot water circulation system 730 may further comprise a pump 740, an inline heater 750, a direction control valve 760, and an overflow assembly 770. Water that is suctioned through the first suction system 720 may be directed towards the pump 740. The pump 740 is configured to keep the water flowing through the hot water circulation system 730 by pumping water towards the inline heater 750. The inline heater 750 may be configured to heat the water coming from the pump 740 such to create hot water. In some embodiments, the pump 740 may direct water towards a different heating element (e.g., phase change material, surface heating, etc.). Once water passes through the inline heater 750, the water goes to the direction control valve 760. At the direction control valve 760, the water may flow back to the bath system 500 or to the overflow assembly 770. The direction control valve 760 is configured to direct the water flowing the hot water circulation system 730. Water that flows to bath system 500 passes through the first whirlpool nozzles 705 as hot water. Water that does not flow back to the bath system 500 flows towards the overflow assembly 770 where the water may drain from the bath system 500. According to an exemplary embodiment, the hot water circulation system 730 may further comprise additional circulation accessories (e.g., filtration system, water reservoir, etc.) positioned in a plurality of positions along the hot water circulation system 730.

Figure 19:
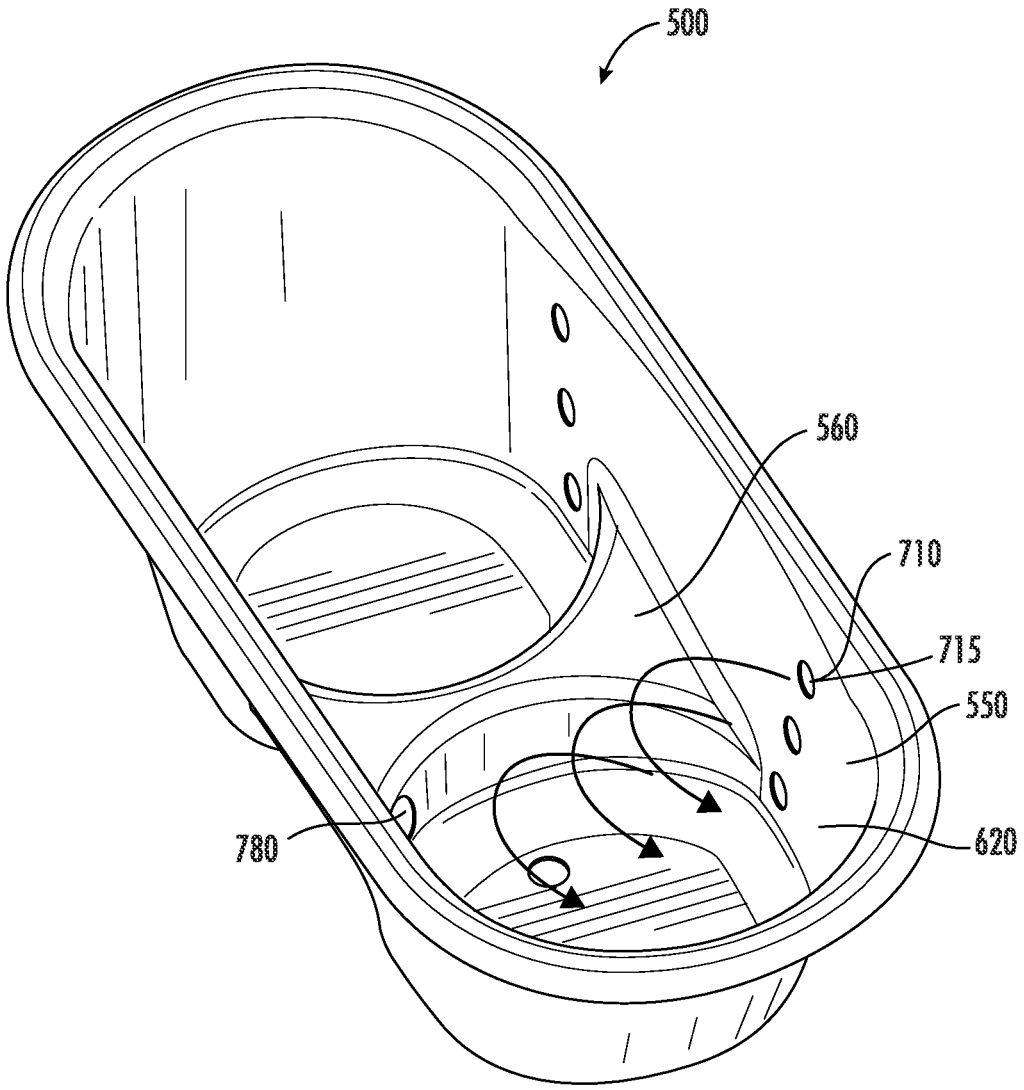
FIG. 19 is a perspective, top view of the bath system of FIG. 11 showing cold water circulation, according to an exemplary embodiment.

Referring now to FIG. 19, a perspective, top view of the bath system 500 of FIG. 11 showing cold water circulation is shown. The cold water zone 620 further comprises a suction port, shown as second suction system 780. The second suction system 780 is configured to suction water from the cold water zone 620 and circulate that water through a cooling system, further described in FIG. 11. In some embodiments, the second suction system 780 may further include a filter system that is configured to filter out foreign particles (e.g., skin, hair, etc.). At least a portion of the water that is suctioned into the second suction system 780 may be blown back into the cold water zone 620 through the second whirlpool nozzles 715. In some embodiments, at least a portion of the water that is suctioned into the second suction system 780 may not be blown back into the cold water zone 620 and instead be routed into an overflow region. As shown, the cold water zone 620 is configured to be a rounded geometry. The rounded geometry of the cold water zone 620 makes it advantageous for the second whirlpool system 710 to circulate hot water within the cold water zone 620 such to eliminate stagnant water. As can be appreciated, the second whirlpool system 710 keeps the water disposed within the cold water zone 620 clean and warm with the circulation process.

Figure 20:
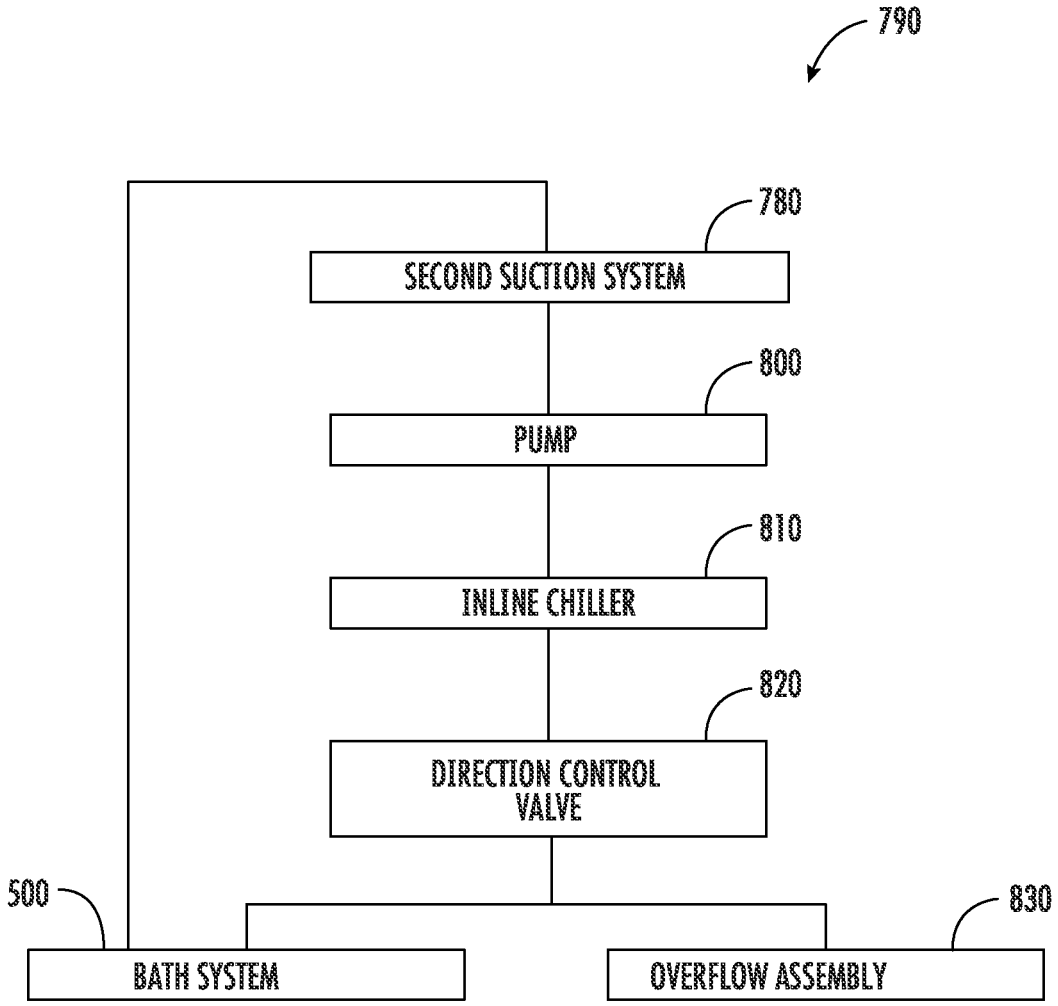
FIG. 20 is a block diagram showing the flow of cold water within the bath system of FIG. 11, according to an exemplary embodiment.

Referring to FIG. 20, a block diagram showing a cold water circulation system 790 is shown. The cold water circulation system 790 may further comprise a pump 800, an inline chiller 810, a direction control valve 820, and an overflow assembly 830. Water that is suctioned through the second suction system 780 may be directed towards the pump 800. The pump 800 is configured to keep the water flowing through the cold water circulation system 790 by pumping water towards the inline chiller 810. The inline chiller 810 may be configured to cool the water coming from the pump 800 such to create cold water. In some embodiments, the pump 800 may direct water towards a different cooling element (e.g., phase change material, surface cooling, etc.). Once water passes through the inline chiller 810, the water goes to the direction control valve 820. At the direction control valve 820, the water may flow back to the bath system 500 or to the overflow assembly 830. The direction control valve 820 is configured to direct the water flowing the cold water circulation system 790. Water that flows to bath system 500 passes through the second whirlpool nozzles 715 as cold water. Water that does not flow back to the bath system 500 may flow towards the overflow assembly 830 where the water may drain from the bath system 500. According to an exemplary embodiment, the cold water circulation system 790 may further comprise additional circulation accessories (e.g., filtration system, water reservoir, etc.) positioned in a plurality of positions along the cold water circulation system 790.

The water positioned above the partition 560 may be a mixture of hot water and cold water. To be more precise, the water positioned above the partition 560 may be "intermediate water" having an intermediate temperature. In some embodiments, the hot and cold water circulation previously described is limited to the hot and cold water within the portions of the basins 540 and 550 below the partition 560 and does not cause substantial movement or circulation of the intermediate water located above the partition 560. For example, the nozzles and the suction may be oriented to cause the flow of water in a substantially horizontal circulation pattern below the partition 560 that does not substantially mix with the intermediate water above the partition 560. In some embodiments, the intermediate water may have circulation between the set of basins 540 and 550. In still some embodiments, the bath system 500 may not include a partition 560. In such an embodiment, at least one of the hot water circulation system 730 and the cold water circulation system 790 may output water at an increasing power such to lower the chance of the hot and cold water mixing.

In some embodiments, the bath system 500 may further comprise at least a portion of insulation. The insulation may be positioned along the outside of the bath system 500 such to insulate a portion of the bath system 500. In some embodiments, insulation may be placed between the set of basins 540 and 550 (e.g., within the partition 560). The insulation may be any of blown insulation, foam insulation, fiberglass insulation, cellulose insulation or the like. The insulation may further surround at least one of the inline heater 750 and the inline chiller 810. The water in the respective hot water zone 590 and cold water zone 620 is configured to circulate in opposing directions. To be more precise, the hot water may circulate in a counterclockwise direction in the hot water zone 590 and the cold water may circulate in a clockwise direction in the cold water zone 620. In some embodiments, the hot water may circulate in the clockwise direction in the hot water zone 590 and the cold water may circulate in the counterclockwise direction in the cold water zone 620.

The water flowing within both the hot water zone 590 and the cold water zone 620 are configured to flow in opposite rotational directions. For example, the water within the hot water zone 590 may flow in the clockwise rotational direction and the water within the cold water zone 620 may flow in the counterclockwise rotational direction, or vice versa. The opposite rotational directions of the hot water and the cold water may result in the hot and cold water flowing in the same translational direction along the respective surfaces of the partition 560 in the adjacent hot water zone 590 and cold water zone 620. The flow rate of the water within the respective hot water zone 590 and cold water zone 620 are configured to have a flow rate high enough to prevent the water from mixing over the partition 560. In some embodiments, the water does not mix over the partition 560 due to the hot water and cold water having different density (e.g., the density of water varies based on temperature).

As can be appreciated, the respective hot water zone 590 and cold water zone 620 may maintain consistent hot and cold water temperatures. The user may easily transition between the hot water zone 590 and the cold water zone 620 such to create a therapeutic effect. To be more precise, the user may consistently transition between hot and cold water to perform a process similar to contrast bath therapy. Contrast bath therapy utilizes the process of consistent hot and cold water circulation such to increase blood flow within the body. In some embodiments, the user may alter at least one of the hot water circulation system 730 and the cold water circulation system 790 to change the power of the water circulation. In such an embodiment, the user may change the water temperature in at least one of the first basin 540 and the second basin 550 such to create a similar therapeutic effect.

Figure 21:
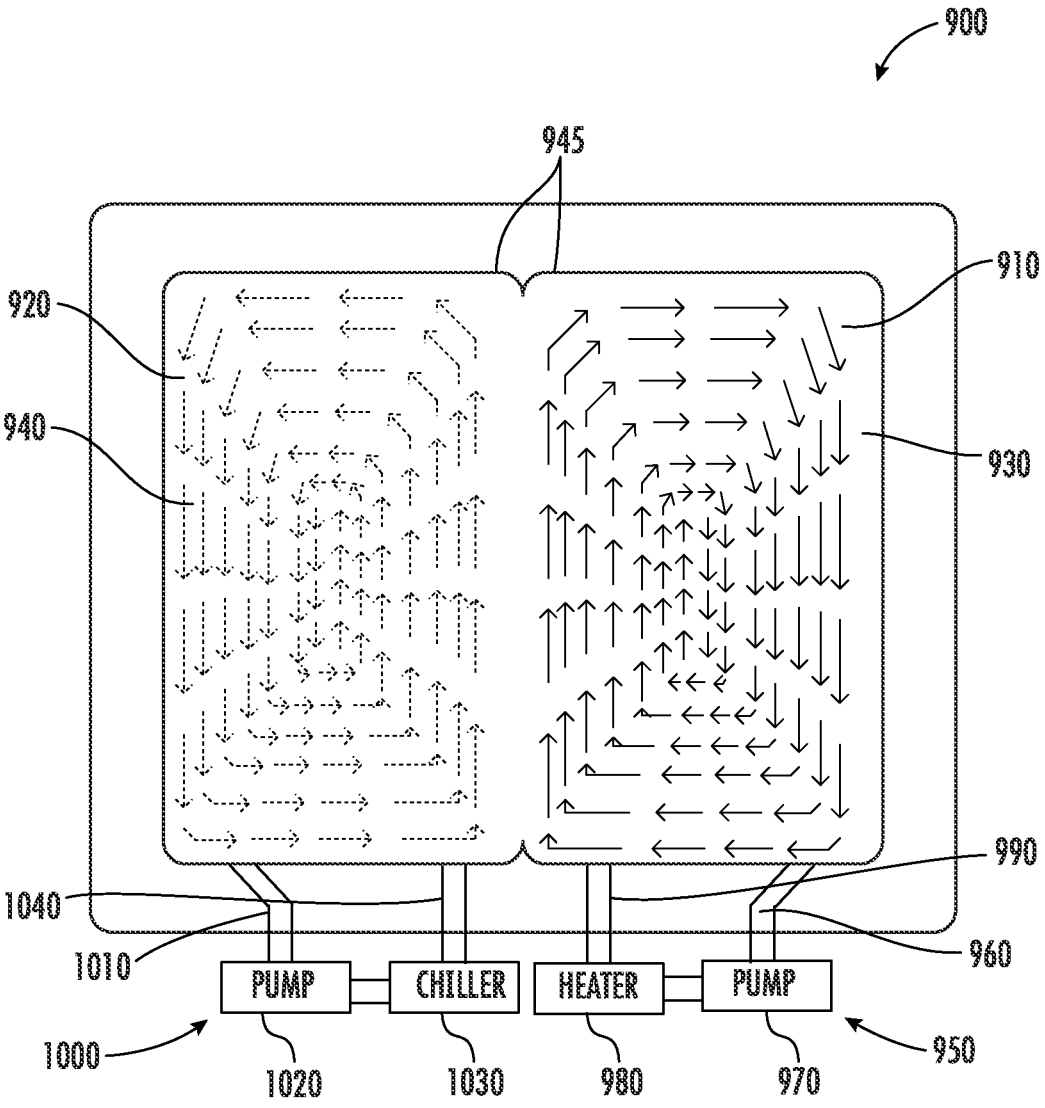
FIG. 21 is a top view of a bath system, according to an exemplary embodiment.

According to an exemplary embodiment shown in FIG. 21, a bath system 900 is shown. The bath system 900 may include any of the features or functionality of bath system 100 and/or bath system 500 as previously described, with the exception of the partition physically separating the hot and cold water zones. The bath system 900 includes a first basin 910 and a second basin 920. The first basin 910 and the second basin 920 are fluidly coupled to one another at a midpoint of the bath system 900. The first basin 910 may be configured to hold hot water within, such that the first basin 910 may further be a hot water zone 930. The second basin 920 may be configured to hold cold water within, such that the second basin 920 may further be a cold water zone 940. Positioned between the first basin 910 and the second basin 920 is a radius portion 945. The first basin 910 is configured to include at least one radius portion 945. The second basin 920 is configured to include at least one radius portion 945. By way of example, both the basins 910 and 920 include two radius portions 945.

As depicted in FIG. 21, the hot and cold water disposed within the hot water zone 930 and the cold water zone 940 are configured to circulate within their respective zones. The direction of flow of both the hot water and the cold water is configured to be parallel to one another. The radius portion 945 is configured to direct the water within the respective basins 910 and 920. The water redirection about the radius portion 945 is configured to promote vortex formation within both the basins 910 and 920. By way of example, a hot water vortex is formed within the hot water zone 930 and a cold water vortex is formed within the cold water zone 940 where the vortexes circulate at a flow high enough to prevent the water from mixing between the first basin 910 and the second basin 920. In still some embodiments, the water does not mix between the first basin 910 and the second basin 920 due to the hot water and cold water having different density (e.g., the density of water varies based on temperature).

The hot water zone 930 further comprises a hot water circulation system 950 positioned along at least one of the sidewalls of the first basin 910. The hot water circulation system 950 may include a suction inlet 960, a pump 970, a heater 980, and a hot water inlet 990. At least some of the water is configured to be directed into the suction inlet 960 where the water cycles through the pump 970 then the heater 980 and is entered back into the hot water zone 930 through the hot water inlet 990. By way of example, the hot water circulation system 950 is configured to maintain a temperature range of the water disposed within.

The cold water zone 940 further comprises a cold water circulation system 1000 positioned along at least one of the sidewalls of the second basin 920. The cold water circulation system 1000 may include a suction inlet 1010, a pump 1020, a chiller 1030, and a cold water inlet 1040. At least some of the water is configured to be directed into the suction inlet 1010 where the water cycles through the pump 1020 then the chiller 1030 and is entered back into the cold water zone 940 through the cold water inlet 1040. By way of example, the cold water circulation system 1000 is configured to maintain a temperature range of the water disposed within.

As utilized herein with respect to numerical ranges, the terms "approximately," "about," "substantially," and similar terms generally mean+/−10% of the disclosed values, unless specified otherwise. As utilized herein with respect to structural features (e.g., to describe shape, size, orientation, direction, relative position, etc.), the terms "approximately," "about," "substantially," and similar terms are meant to cover minor variations in structure that may result from, for example, the manufacturing or assembly process and are intended to have a broad meaning in harmony with the common and accepted usage by those of ordinary skill in the art to which the subject matter of this disclosure pertains. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above.

It is important to note that any element disclosed in one embodiment may be incorporated or utilized with any other embodiment disclosed herein. For example, the bath system 100 of the exemplary embodiment described in at least FIGS. 1-10 may be incorporated with the bath system 500 of the exemplary embodiment described in at least FIGS. 9-20. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A bath system, comprising:

a bath receptor, comprising:

a water inlet configured to supply water to the bath receptor;

a first basin comprising a first whirlpool system configured to direct water in a clockwise rotational direction within the first basin;

a second basin comprising a second whirlpool system configured to direct water in a counter-clockwise rotational direction within the second basin, the counter-clockwise rotational direction opposite the clockwise rotational direction; and a partition positioned between the first basin and the second basin and physically coupled to the first basin and the second basin, the partition vertically provided along at least a portion of a height of the bath receptor, wherein the water from the first basin and the water from the second basin are directed in a same translational direction along the partition.

2. The bath system of claim 1, wherein the first whirlpool system comprises a heating element configured to form hot water passing through the first whirlpool system, and wherein the second whirlpool system comprises a cooling element configured to form cold water passing through the second whirlpool system.

3. The bath system of claim 2, wherein the first whirlpool system is configured to form a hot water vortex within the first basin, and wherein the second whirlpool system is configured to form a cold water vortex within the second basin.

4. The bath system of claim 1, wherein the first whirlpool system comprises a first suction system positioned proximate a bottom of the first basin, and wherein the second whirlpool system comprises a second suction system positioned proximate a bottom of the second basin.

5. The bath system of claim 1, wherein the first basin further comprises a first shallow zone and a first deep zone, the first shallow zone defining a first water depth and the first deep zone defining a second water depth, and wherein the first water depth is less than the second water depth.

6. The bath system of claim 1, wherein a height of the partition is less than the height of the bath receptor such that the water in the first basin and the water in the second basin converge along a fluid contact plane vertically provided above the partition when a water level within the first basin and the second basin exceeds the height of the partition.

7. The bath system of claim 1, wherein the first whirlpool system further comprises a first plurality of jets configured to output water into the first basin at an angle relative to a sidewall of the first basin, and wherein the second whirlpool system further comprises a second plurality of jets configured to output water into the second basin at an angle relative to a sidewall of the second basin.

8. The bath system of claim 1, wherein a sidewall of the first basin includes a radius portion adjacent to the partition and configured to direct water in an annular direction aligned with a side wall of the partition.

9. A bath receptor, comprising:

a first basin comprising:

a first whirlpool system fluidly coupled to the first basin and comprising a heating element configured to heat water passing through the first whirlpool system, the first whirlpool system configured to direct hot water in a first direction; and a first basin floor and a first basin drain, the first basin floor being sloped towards the first basin drain; and a second basin comprising:

a second whirlpool system fluidly coupled to the second basin and comprising a cooling element configured to cool water passing through the second whirlpool system, the second whirlpool system configured to direct cold water in a second direction; and a second basin floor and a second basin drain, the second basin floor being sloped towards the second basin drain;

wherein the first whirlpool system is configured to form a hot water vortex within the first basin and wherein the second whirlpool system is configured to form a cold water vortex within the second basin; and wherein the first basin floor and the second basin floor are sloped in opposite directions.

10. The bath receptor of claim 9, wherein the first whirlpool system further comprises a first plurality of jets configured to output water into the first basin at an angle relative to a sidewall of the first basin, and wherein the second whirlpool system further comprises a second plurality of jets configured to output water into the second basin at an angle relative to a sidewall of the second basin.

11. The bath receptor of claim 9, wherein the first whirlpool system comprises a first suction system positioned proximate a bottom of the first basin, and wherein the second whirlpool system comprises a second suction system positioned proximate a bottom of the second basin.

12. The bath receptor of claim 11, wherein the hot water vortex directs water from an outer portion of the first basin to an inner portion of the first basin proximate the first suction system, and wherein the cold water vortex directs water form an outer portion of the second basin to an inner portion of the second basin proximate the second suction system.

13. The bath receptor of claim 9, further comprising a partition positioned between the first basin and the second basin, and wherein the water in the first basin and the water in the second basin converge along a fluid contact plane vertically provided above the partition.

14. The bath receptor of claim 9, further comprising a partition positioned between the first basin and the second basin, and wherein the first direction is a clockwise rotational direction within the first basin and the second direction is a counter-clockwise rotational direction within the second basin, and wherein the water is directed in a same translational direction along the partition.

15. A water circulation system, comprising:

a first basin comprising a first whirlpool system fluidly coupled to the first basin, the first whirlpool system comprising a heating element configured to heat water passing through the first whirlpool system to form hot water;

a second basin comprising a second whirlpool system fluidly coupled to the second basin, the second whirlpool system comprising a cooling element configured to cool water passing through the second whirlpool system to form cold water; and a partition positioned between the first basin and the second basin and physically coupled to both the first basin and the second basin, the partition having a height less than a height of the first basin and the second basin;

wherein the hot water and the cold water converge on a fluid contact plane vertically provided above the partition.

16. The water circulation system of claim 15, wherein the first whirlpool system directs water in a clockwise rotational direction within the first basin and the second whirlpool system directs water in a counter-clockwise rotational direction within the second basin, and wherein the water is directed in a same translational direction along the partition.

17. The water circulation system of claim 15, wherein the first whirlpool system further comprises a first plurality of jets configured to output water into the first basin at an angle relative to a sidewall of the first basin, and wherein the second whirlpool system further comprises a second plurality of jets configured to output water into the second basin at an angle relative to a sidewall of the second basin.

18. The water circulation system of claim 15, wherein the first whirlpool system comprises a first suction system positioned proximate a bottom of the first basin, and wherein the second whirlpool system comprises a second suction system positioned proximate a bottom of the second basin.

* * * * *